US012765665B2

(12) United States Patent
Mensing et al.

(10) Patent No.: US 12,765,665 B2
(45) Date of Patent: Oct. 20, 2026

(54) WORKSTATION WITH MODULAR CONSTRUCTION

(71) Applicant: Ergotron, Inc., St. Paul, MN (US)

(72) Inventors: Jeffrey Randall Mensing, Eden Prairie, MN (US); Jonathan Northcutt Dunn, Maple Grove, MN (US); James Robert Lucas, Minneapolis, MN (US); Megan T. Brosnan, Minnetonka, MN (US)

(73) Assignee: Ergotron, Inc., St. Paul, MN (US)

( * ) Notice: Subject to any disclaimer, the term of this patent is extended or adjusted under 35 U.S.C. 154(b) by 148 days.

(21) Appl. No.: 18/694,887

(22) PCT Filed: Aug. 25, 2022

(86) PCT No.: PCT/US2022/075464

§ 371 (c)(1),
(2) Date: Mar. 22, 2024

(87) PCT Pub. No.: WO2023/056144

PCT Pub. Date: Apr. 6, 2023

(65) Prior Publication Data

US 2024/0407543 A1 Dec. 12, 2024

Related U.S. Application Data

(60) Provisional application No. 63/250,780, filed on Sep. 30, 2021.

(51) Int. Cl.
*A47B 21/02* (2006.01)
*A47B 21/03* (2006.01)
(Continued)

(52) U.S. Cl.
CPC ..... *A47B 21/02* (2013.01); *A47B 21/03* (2013.01); *A47B 21/04* (2013.01); *A47B 2021/0364* (2013.01); *A47B 2021/066* (2013.01)

(58) Field of Classification Search
CPC ..... A47B 21/02; A47B 21/03; A47B 21/04; A47B 21/0314; A47B 3031/0364;
(Continued)

(56) References Cited

U.S. PATENT DOCUMENTS

D553,324 S 10/2007 Lieblein
7,791,866 B2 * 9/2010 Clark ..... G16H 40/67 361/679.01
(Continued)

FOREIGN PATENT DOCUMENTS

CN 201631562 U * 11/2010
CN 211336029 U 8/2020
(Continued)

OTHER PUBLICATIONS

WO2012157597 English translation (Year: 2012).*
(Continued)

*Primary Examiner* — Janet M Wilkens
(74) *Attorney, Agent, or Firm* — Schwegman Lundberg & Woessner, P.A.

(57) ABSTRACT

A workstation having modular components is described. Modular components include a support column, a head unit assembly including a worksurface, and one or more display mounts among other things. Modular components are coupled to a structure including a wall, a pole, a cabinet, a rack, a wheeled base, or the like. Modular components include features to interface with each other and with the structure. The workstation is easily configurable by the user of the workstation to include the desired modules coupled to a desired structure to perform intended workstation functions.

20 Claims, 24 Drawing Sheets

(51) Int. Cl.
*A47B 21/04* (2006.01)
*A47B 21/06* (2006.01)

(58) Field of Classification Search
CPC ..... A47B 3031/066; A47B 2200/0076; B62B 3/02; B62B 3/00; B62B 2202/56; B62B 2202/61; B62B 2206/06; B62B 5/0053
USPC ..... 312/21, 50.01, 50.02, 96, 147, 147.19, 312/150, 151; 361/679.02, 679.01, 361/679.08; 280/47.35
See application file for complete search history.

(56) References Cited

U.S. PATENT DOCUMENTS

| | | | | |
|---|---|---|---|---|
| 8,398,408 | B1 * | 3/2013 | Hansen | A61B 8/4405 320/109 |
| 8,814,107 | B2 | 8/2014 | Hampe et al. | |
| 8,924,258 | B2 | 12/2014 | Knoll et al. | |
| 8,937,815 | B2 | 1/2015 | De Jong et al. | |
| 9,256,865 | B2 | 2/2016 | Knoll et al. | |
| 9,481,386 | B2 | 11/2016 | Martell et al. | |
| 9,775,430 | B2 | 10/2017 | Abu-akel et al. | |
| D860,464 | S | 9/2019 | Caywood et al. | |
| 10,453,572 | B1 * | 10/2019 | Brooks | G16H 40/40 |
| 2005/0035198 | A1 | 2/2005 | Wilensky | |
| 2007/0227409 | A1 * | 10/2007 | Chu | A47B 21/00 108/50.02 |
| 2007/0228680 | A1 | 10/2007 | Reppert et al. | |
| 2008/0251661 | A1 | 10/2008 | Rossini | |
| 2008/0252045 | A1 | 10/2008 | Rossini et al. | |
| 2011/0232535 | A1 * | 9/2011 | Hung | A61G 12/001 108/50.02 |
| 2012/0170293 | A1 * | 7/2012 | Terry | F16M 11/28 248/74.1 |
| 2013/0307237 | A1 * | 11/2013 | Chen | A61G 12/001 280/35 |
| 2016/0015167 | A1 | 1/2016 | Abu-akel et al. | |
| 2018/0289312 | A1 | 10/2018 | Perkins et al. | |
| 2019/0269236 | A1 | 9/2019 | Lindblad et al. | |
| 2019/0269239 | A1 | 9/2019 | Lindblad et al. | |
| 2019/0270471 | A1 | 9/2019 | Hazzard et al. | |
| 2021/0024112 | A1 | 1/2021 | Ting et al. | |
| 2021/0267707 | A1 | 9/2021 | Sung et al. | |
| 2021/0318724 | A1 | 10/2021 | Sung et al. | |
| 2025/0251075 | A1 * | 8/2025 | Gagne | A47B 57/485 |

FOREIGN PATENT DOCUMENTS

| | | | | |
|---|---|---|---|---|
| CN | 214202554 | U | 9/2021 | |
| CN | 220477769 | U * | 2/2024 | |
| CN | 118176092 | | 6/2024 | |
| DE | 112022004691 | | 7/2024 | |
| WO | WO-2004066595 | A2 | 8/2004 | |
| WO | WO-2011113090 | A1 | 9/2011 | |
| WO | WO-2012157597 | A1 * | 11/2012 | B62B 3/10 |
| WO | WO-2014133915 | A1 * | 9/2014 | A47B 21/06 |
| WO | WO-2020014283 | A1 * | 1/2020 | B25H 1/12 |
| WO | WO-2020146329 | A2 | 7/2020 | |
| WO | WO-2021050897 | A1 * | 3/2021 | A47B 21/02 |
| WO | WO-2023056144 | A1 | 4/2023 | |

OTHER PUBLICATIONS

"International Application Serial No. PCT/US2022/075464, International Search Report mailed Dec. 8, 2022", 2 pgs.
"International Application Serial No. PCT/US2022/075464, Written Opinion mailed Dec. 8, 2022", 10 pgs.
"International Application Serial No. PCT US2022 075464, International Preliminary Report on Patentability mailed Apr. 11, 2024", 12 pgs.
"Canadian Application Serial No. 3,233,400, Voluntary Amendment Filed Apr. 29, 2024", 7 pgs.
"Canadian Application Serial No. 3233400, Examiners Rule 86(2) Report mailed Nov. 3, 2025", 4 pgs.
"Canadian Application Serial No. 3233400, Response filed Feb. 17, 2026 to Examiners Rule 86(2) Report mailed Nov. 3, 2025", w/ claims, 10 pgs.

* cited by examiner

WORKSTATION WITH MODULAR CONSTRUCTION

CLAIM OF PRIORITY

This patent application is a 371 National Stage of PCT/US2022/075464, entitled "A WORKSTATION WITH MODULAR CONSTRUCTION," filed on Aug. 25, 2022, and published as WO 2023/056144 A1 on Apr. 6, 2023, which claims the benefit of priority of Mensing, et al. U.S. Provisional Patent Application Ser. No. 63/250,780, entitled "A WORKSTATION WITH MODULAR CONSTRUCTION," filed on Sep. 30, 2021, which are hereby incorporated by reference herein in their entirety.

TECHNICAL FIELD

This document pertains generally, but not by way of limitation, to modular construction of workstations with height adjustable worksurface.

BACKGROUND

Computing workstations are widely used in different parts of a facility (e.g., production floor, assembly line, warehouse, hospital patient room, or the like). These workstations can be stationary (e.g., mounted on a wall, mounted on a pole, mounted on a table, or the like), or they can be mobile having a wheeled base. Some workstations can be powered using a built-in power system, others can be non-powered. Some workstations can have a CPU holder and at least one display mounting option, yet other workstations can be used with a notebook that does not require an additional display mount. Some workstations can require additional accessories (e.g., a printer, a locking drawer, one or more shelves, a tool holder, a scanner holder, or the like) depending on their use. Therefore, an easily configurable mobile workstation based on a common platform would be very desirable. The user of the workstation can build the workstation with desired capabilities using some standard building blocks.

BRIEF DESCRIPTION OF THE DRAWINGS

The following drawings are illustrative of particular embodiments of the present invention and therefore do not limit the scope of the invention. The drawings are not to scale and are intended for use in conjunction with the explanations in the following detailed description. Like numerals may describe similar components in different views. Like numerals having different letter suffixes may represent different instances of similar components. The drawings illustrate generally, by way of example, but not by way of limitation, various embodiments discussed in the present document.

OVERVIEW

This disclosure describes a workstation built with modular components. These modular components can be the building blocks that can be used by a user to easily configure the workstation according to desired features. Some example modular components of a workstation can include a height adjustable riser, a worksurface, a display mount, a handle, a power system, a shelf, a drawer, or the like. The workstation can be mounted on structure including any fixed or mobile support surface (e.g., a wall, on a wheeled base, on a pole, or the like).

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

Figure 1:
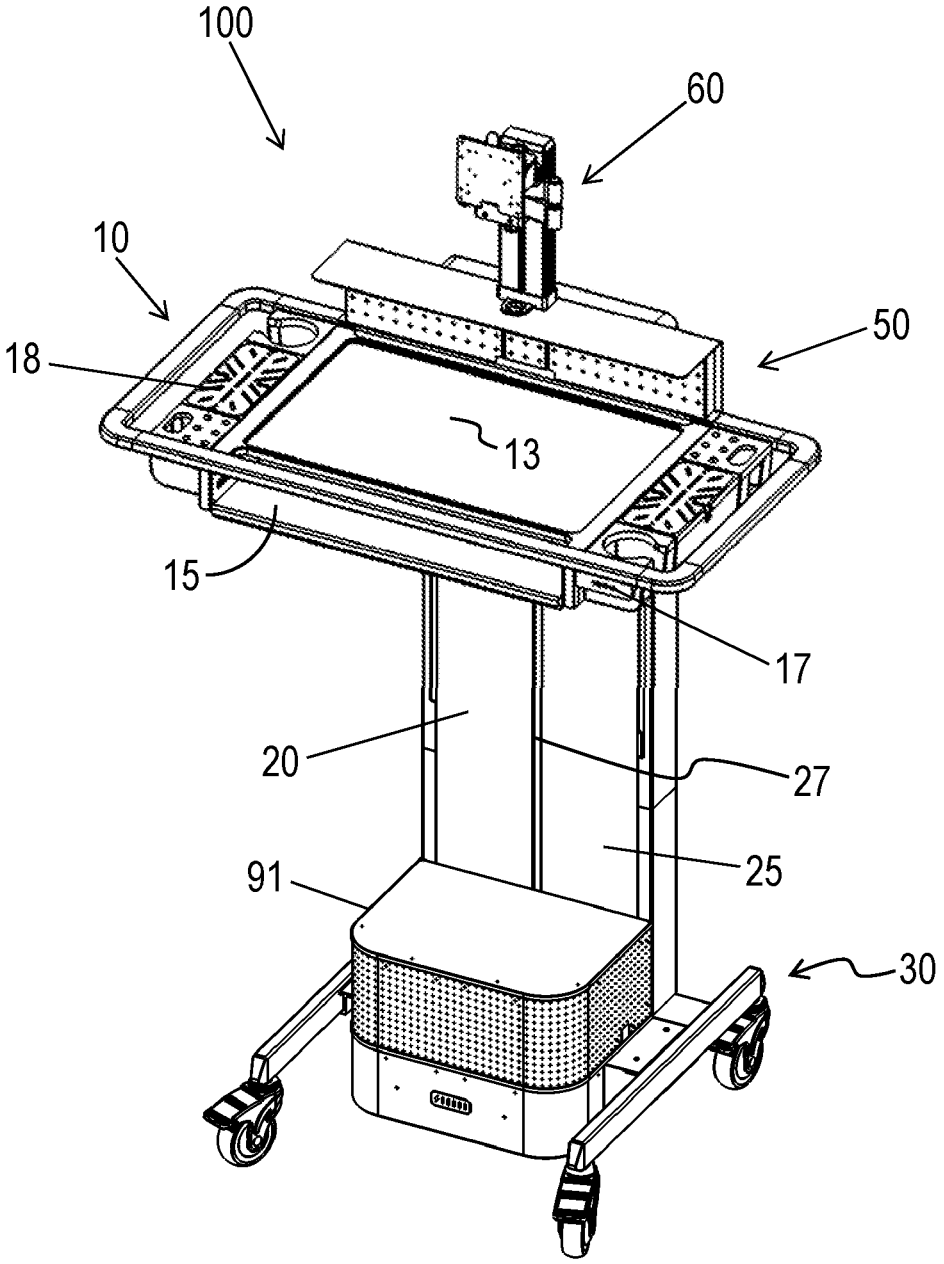
FIG. 1 is a front perspective view of a workstation according to an example configuration of the current disclosure.
Figure 2:
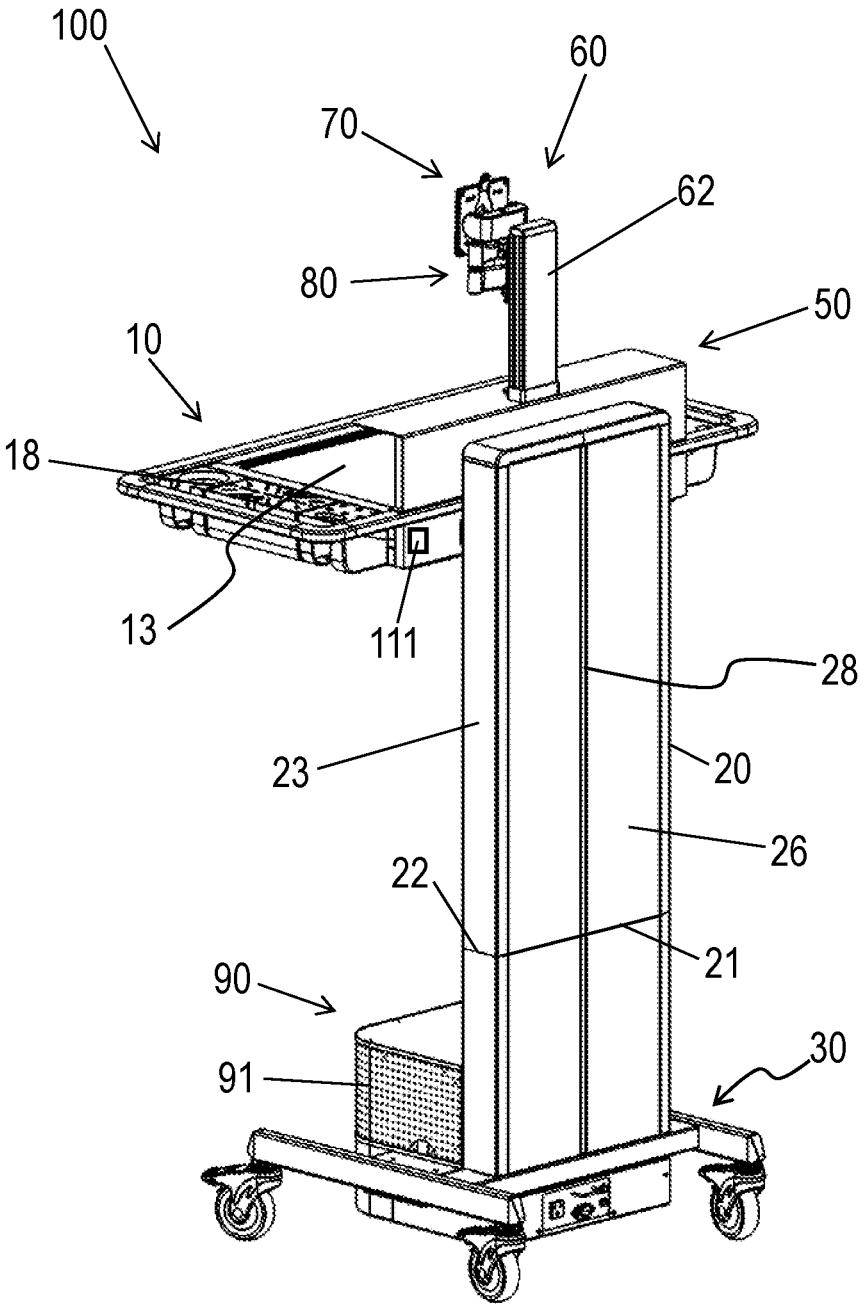
FIG. 2 is a rear perspective views of the workstation of FIG. 1.

FIGS. 1 and 2 are a front and a rear perspective views of an example of a workstation 100, respectively. In some example configurations, the workstation 100 can include a wheeled base 30. A support column 20 can be coupled to the wheeled base 30 at a first end and a head unit assembly 10 can be coupled to the support column 20 proximate a second end. In some example configurations, the head unit assembly 10 can be slidingly engaged with the support column 20.

The support column 20 can have any shape. In some example configurations, the support column 20 can have a rectangular prism construction. The support column 20 can have front surface 25 and a rear surface 26 each having a width 21. The front surface 25 and the rear surface 26 can be coupled to each other via right and left sidewalls 23 with a depth 22. The width 21 and the depth 22 can be in a horizontal plane. The width 21 can be larger than the depth 22. The support column 20 can be elongated in a direction perpendicular to the horizontal plane formed by the width 21 and the depth 22. The elongated length of the support column 20 can form a height of the support column 20. The height of the support column 20 can be substantially larger than the width 21 and the depth 22. The front face 25, the rear face 26 and the sidewalls 23 can form an enclosed volume inside the support column 20. A height adjustment mechanism (e.g., the lift mechanism 372 of FIG. 29, or the linear actuator 380 of FIG. 30) can be located in the enclosed volume. In some example configurations, the head unit assembly 10 can be coupled to the lift mechanism. The lift mechanism can provide assistance for the user of the workstation 100 to adjust a distance between the base and the head unit assembly 10.

In some example configurations, the head unit assembly 10 can include a worksurface 13 and a keyboard tray 15. The keyboard tray 15 can be slidably engaged with the head unit assembly 10. The keyboard tray 15 can be stowed under the worksurface 13 when it is not in use, and it can slide forward away from the worksurface 13 to expose a keyboard (not shown) located on the keyboard tray 15.

In some example configurations, the workstation 100 can include a rack assembly 50 and a display mounting assembly 60. The rack assembly 50 can be coupled to the head unit assembly 10 proximate to its rear end, and the display mounting assembly 60 can be coupled to the rack assembly 50. In other configurations, the display mounting assembly 60 can be directly coupled to the head unit assembly 10 without a rack assembly.

In some example configurations, the display mounting assembly 60 can include a display mounting riser 62, and a tilt assembly 70. The tilt assembly 70 can be operationally coupled to the display mounting riser 62. One or more displays (e.g., the display 442 of FIG. 37) can be coupled to the display mounting riser 62 to position the one or more displays over the worksurface 13.

In some example configurations, an arm assembly 80 can be optionally coupled between the tilt assembly 70 and the display mounting riser 62. In other configurations, the tilt assembly 70 can be directly coupled to the display mounting riser 62. The arm assembly 80 can articulate in a horizontal plane to change an orientation (e.g., change a position or angle) of the tilt assembly 70 relative to the display mounting riser 62. In some example configurations, the tilt assembly 70 and the arm assembly 80 can translate in a vertical direction relative to the display mounting riser 62 to adjust a distance between the tilt assembly 70 and the worksurface 13. In an example, the arm assembly 80 can be similar to (and can incorporate components of) the arm assembly described in commonly assigned U.S. Pat. No. 10,646,033 to Lindblad et al., entitled "HEIGHT ADJUSTABLE PLATFORMS AND ASSOCIATED MECHANISMS", which is hereby incorporated by reference herein in its entirety.

The workstation 100 can further include a power system 90. The power system 90 can be located inside a power system housing 91. The power system housing 91 can be coupled to the wheeled base 30. One or more electrical components (e.g., a computer, a display, a printer, a scanner, or the like) can be coupled to the workstation 100. The power system 90 can be electrically connected to the one or more electrical components coupled to the workstation 100.

Figure 11:
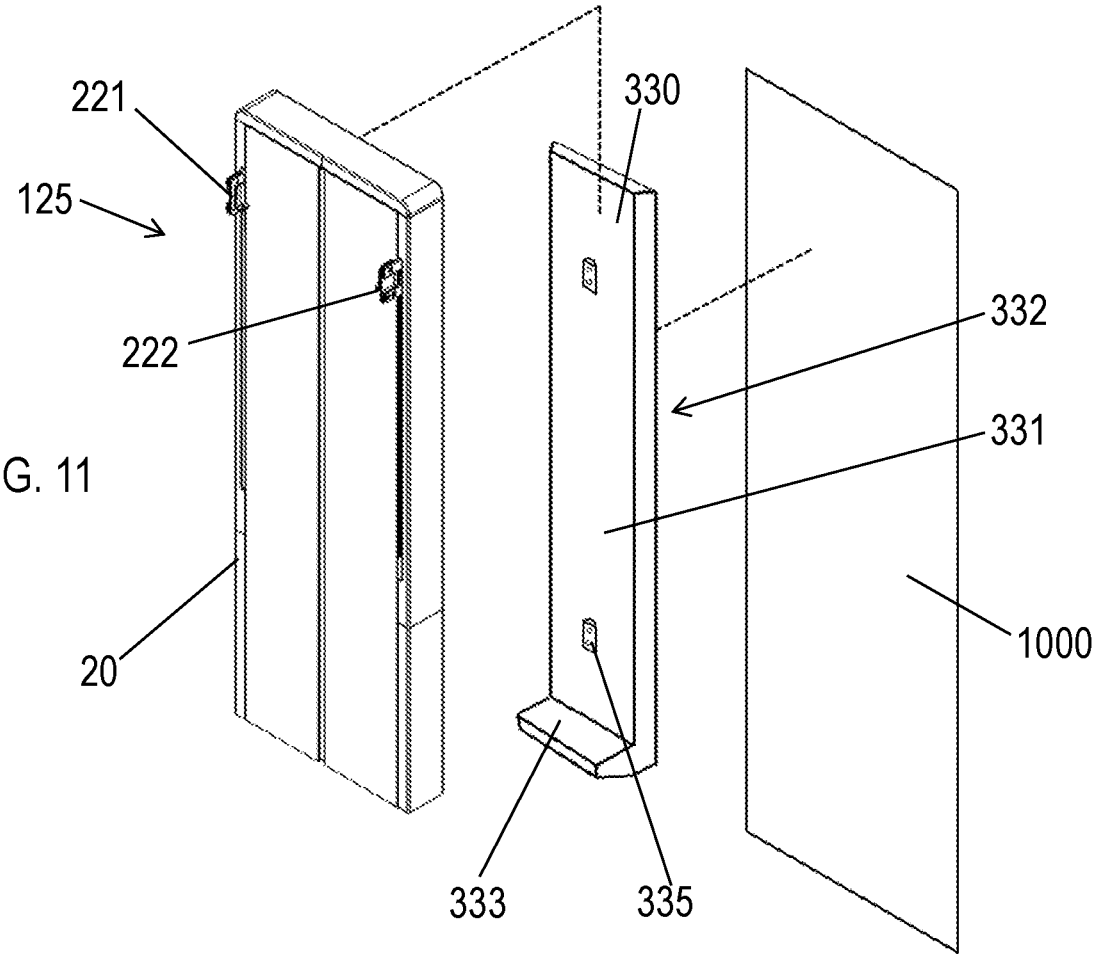
FIG. 11 an exploded view of a workstation mounted on a wall according to another example configuration of the current disclosure.
Figure 34:
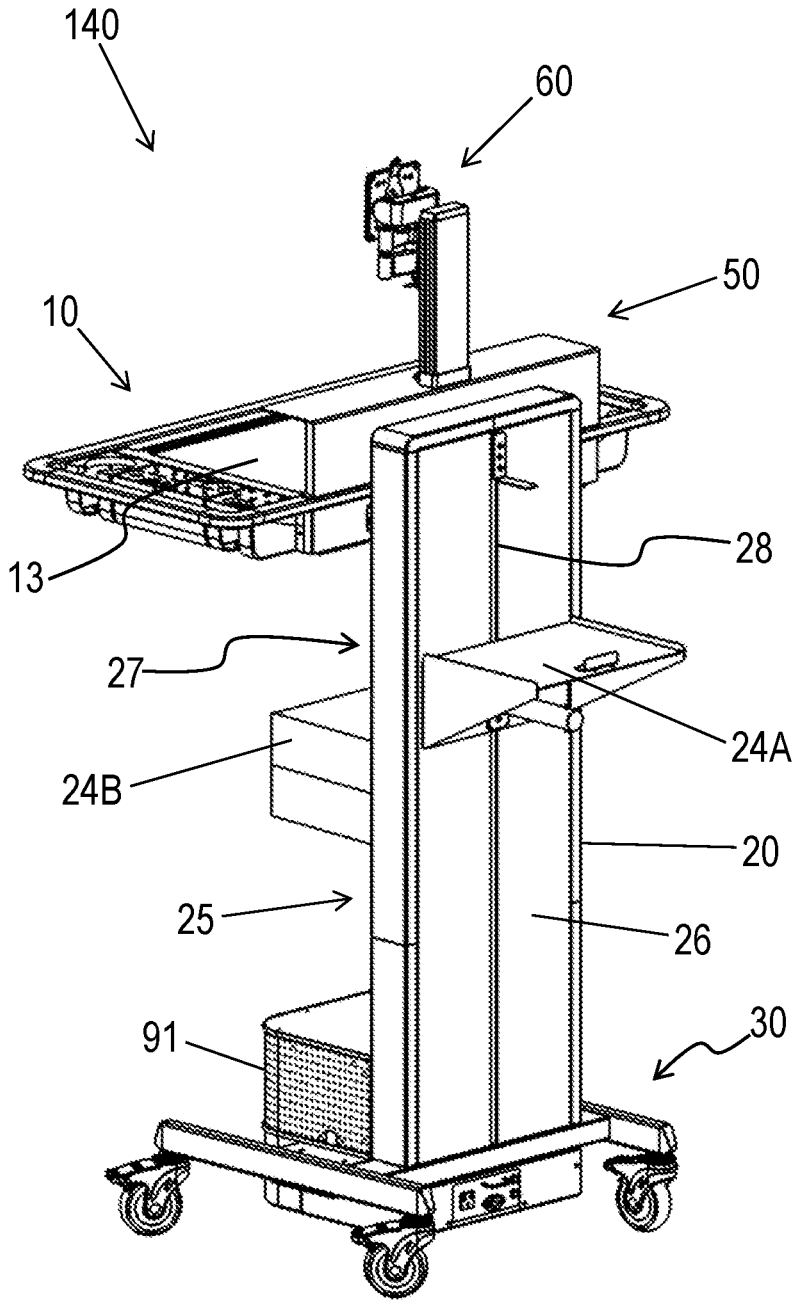
FIG. 34 is a rear perspective view of a workstation according to another example configuration of the current disclosure.

In some example configurations, a front T-slot 27 and a rear T-slot 28 can be formed on the front face 25 and the rear face 26 of the support column 20, respectively. The front T-slot 27 and the rear T-slot 28 can be useful to couple one or more accessories (e.g., a shelf, a drawer, or the like) to the support column 20 as illustrated in FIG. 34. In other configurations, the rear T-slot 28 can be used to couple the support column 20 to a structure (e.g., a wall) as illustrated in FIG. 11.

Figure 3:
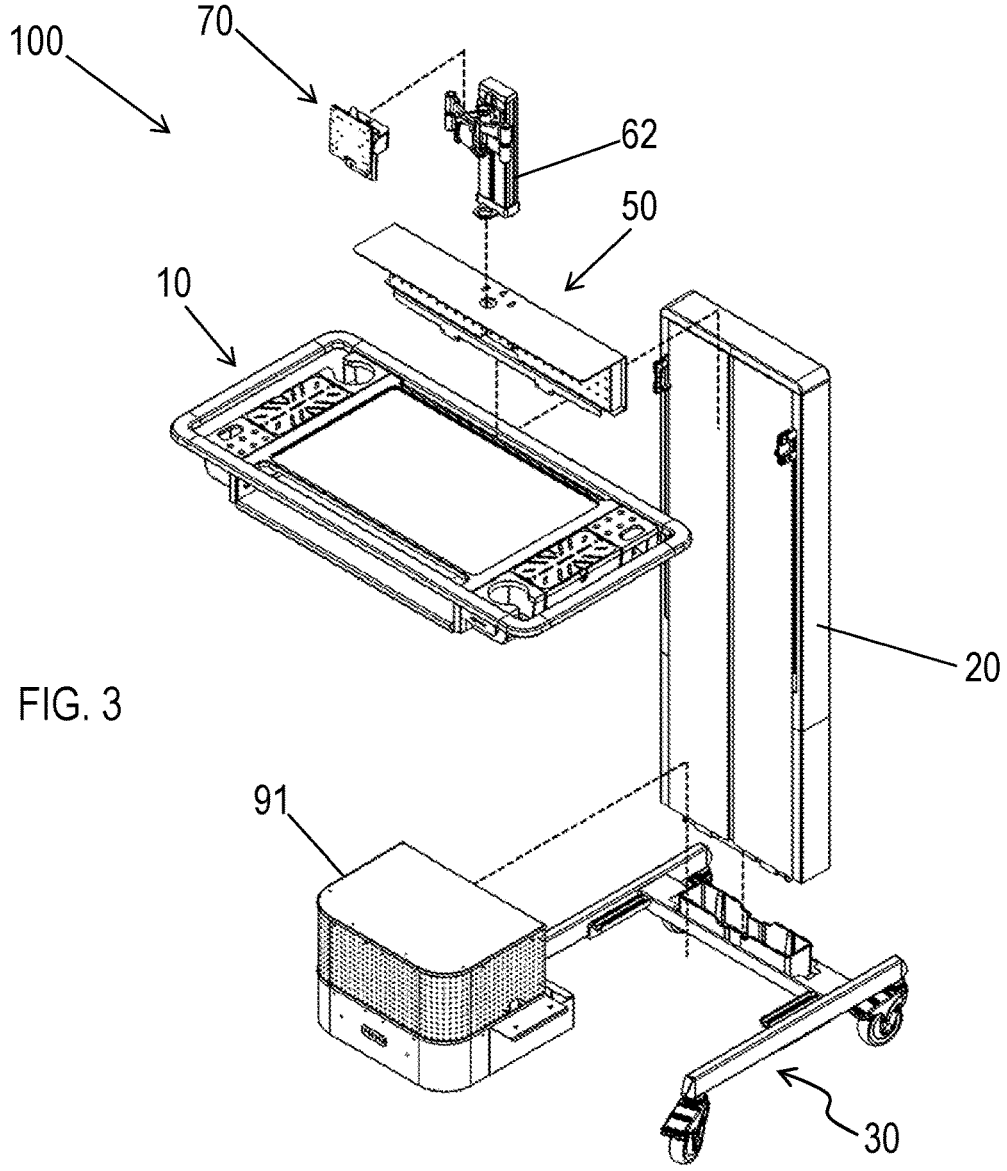
FIG. 3 is an exploded view of the workstation of FIG. 1.

FIG. 3 is an exploded view of the workstation 100 of FIG. 1 according to an example configuration of the current disclosure. The workstation 100 can include one or more modules including, but not limited to, a wheeled base 30, a support column 20, a head unit assembly 10, a rack assembly 50, a display mounting riser 62, a tilt assembly 70, and a power system housing 91. The one or more modules can be coupled together to form the workstation 100.

Figure 4:
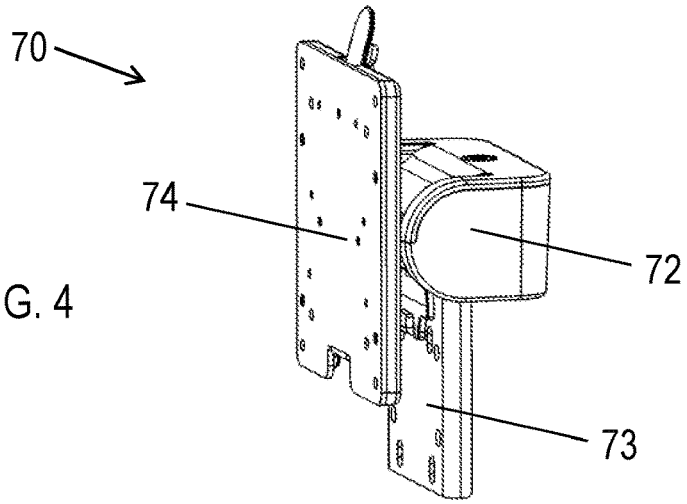
FIG. 4 is a perspective view of the tilt assembly of FIG. 3.

FIG. 4 is a perspective view of the tilt assembly 70 of FIG. 3. The tilt assembly 70 can include a tilt mechanism 72, a connector bracket 73, and a display attachment bracket 74. The tilt mechanism 72 can be coupled to the connector bracket 73. The display attachment bracket 74 can be coupled to a display on one side and coupled to the tilt mechanism 72 on the other side. In some configurations, the display attachment bracket 74 can be removably coupled to the tilt mechanism 72.

Figure 31:
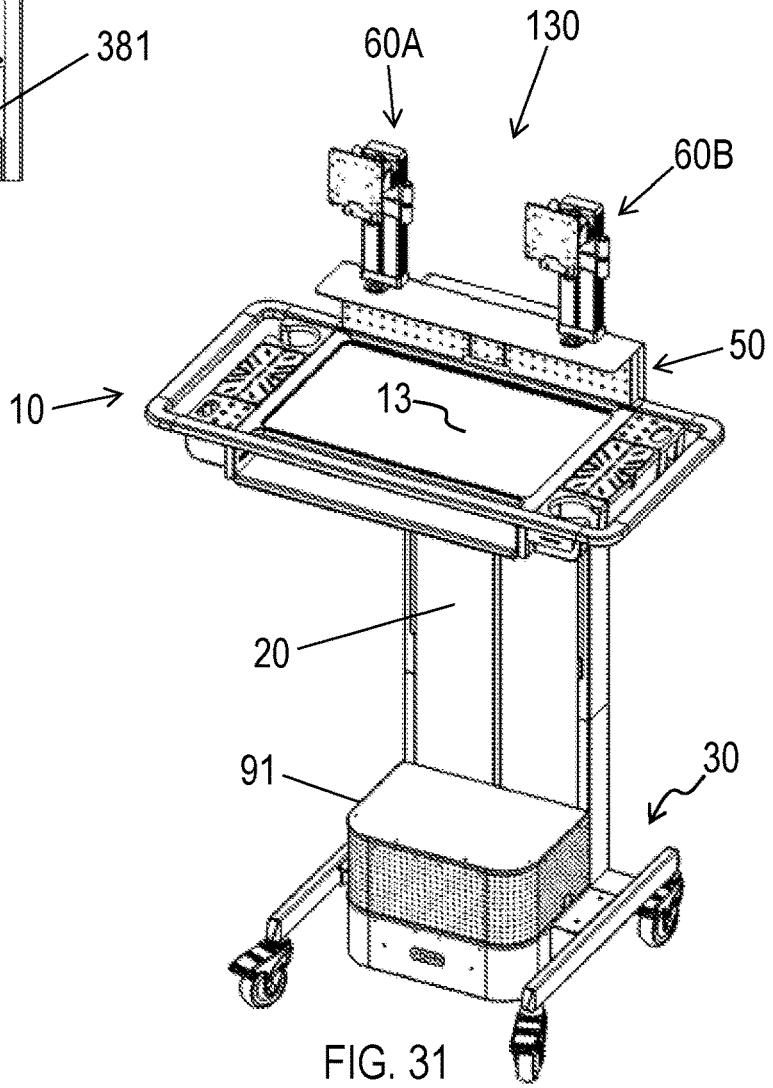
FIG. 31 is a perspective view of a workstation according to another example configuration of the current disclosure.

The tilt assembly 70 can be operationally coupled to the display mounting riser 62 (e.g., the connector bracket 73 can be coupled to the arm assembly 80 of FIG. 1). The tilt mechanism 72 can be adapted to change an orientation (e.g., change an angle) of the display relative to the display mounting riser 62. The tilt assembly 70 can hold a single display over the workstation 100. In other example configurations, it can be desirable to attach two or more displays to the workstation 100 using two or more tilt assemblies as illustrated in FIG. 31.

Figure 5:
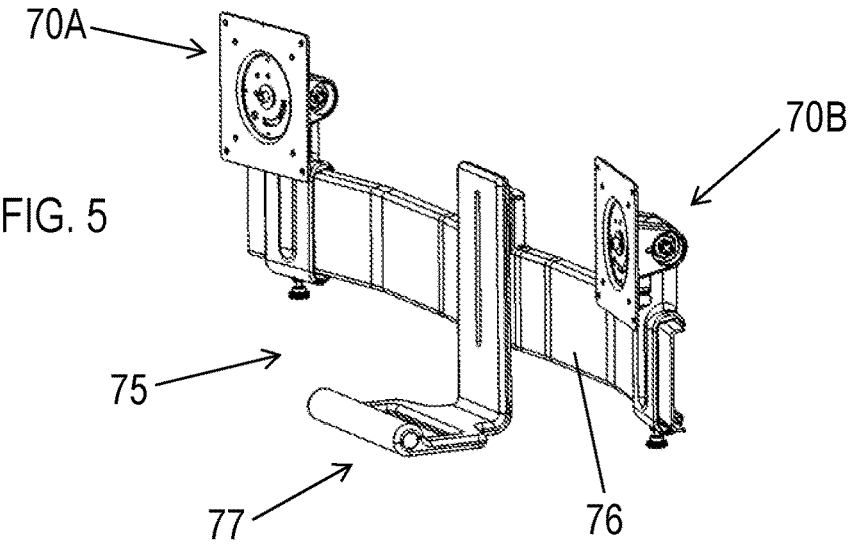
FIG. 5 is a perspective view of a bow assembly according to an example configuration of the current disclosure.

FIG. 5 is a bow assembly 75 according to an example configuration of the current disclosure. The bow assembly 75 can include a bow 76, two or more tilt assemblies (e.g., a first tilt assembly 70A and a second tilt assembly 70B), and a handle assembly 77. In some configurations, the bow assembly 75 can be operationally coupled to the display mounting riser 62 (e.g., the bow 76 can be coupled to the arm assembly 80 of FIG. 1). In other configurations, the bow assembly 75 can be directly coupled to the display mounting riser 62. The bow assembly 75 can be useful to hold the two or more displays over the worksurface 13. Two or more displays can be coupled to the bow assembly 75 through the two or more tilt assemblies (70A and 70B). In an example configuration, the tilt assembly 70 and bow assembly 75 can be similar to (and can incorporate components of) the tilt and bow assemblies described in commonly assigned U.S. Pat. No. 11,112,057 to Janechek et al., entitled "DISPLAY MOUNTING SYSTEM AND METHOD", which is hereby incorporated by reference herein in its entirety.

Figure 6:
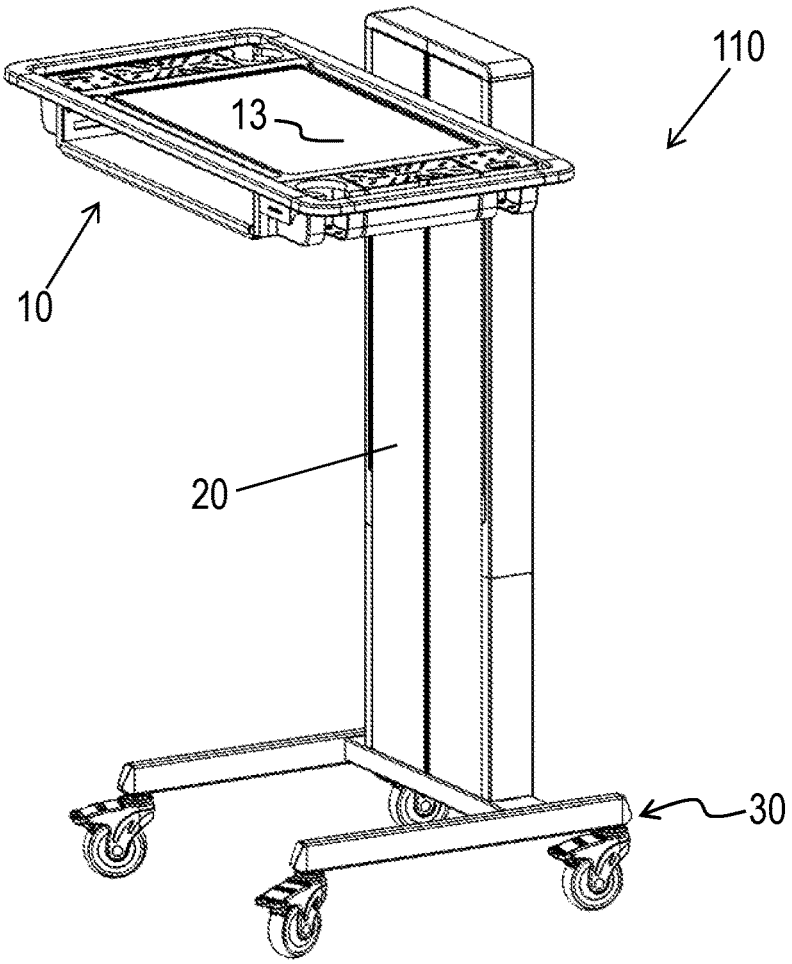
FIG. 6 is a perspective view of a non-powered workstation according to an example configuration of the current disclosure.

FIG. 6 is a perspective view of a non-powered workstation 110 according to an example configuration of the current disclosure. The non-powered workstation 110 can include a wheeled base 30, a support column 20, and a head unit assembly 10. In this example configuration, the non-powered workstation 110 does not have a resident power system. An external power source can be used to provide electrical power to the one or more electronic components (e.g., laptop computer, printer, scanner, or the like) coupled to the non-powered workstation 110. An outlet strip with multiple power outlets (not shown) can be coupled to the non-powered workstation 110. The outlet strip can be connected to the external power source, and the one or more electronic components can be electrically connected to the outlet strip to receive electrical power.

Figure 7:
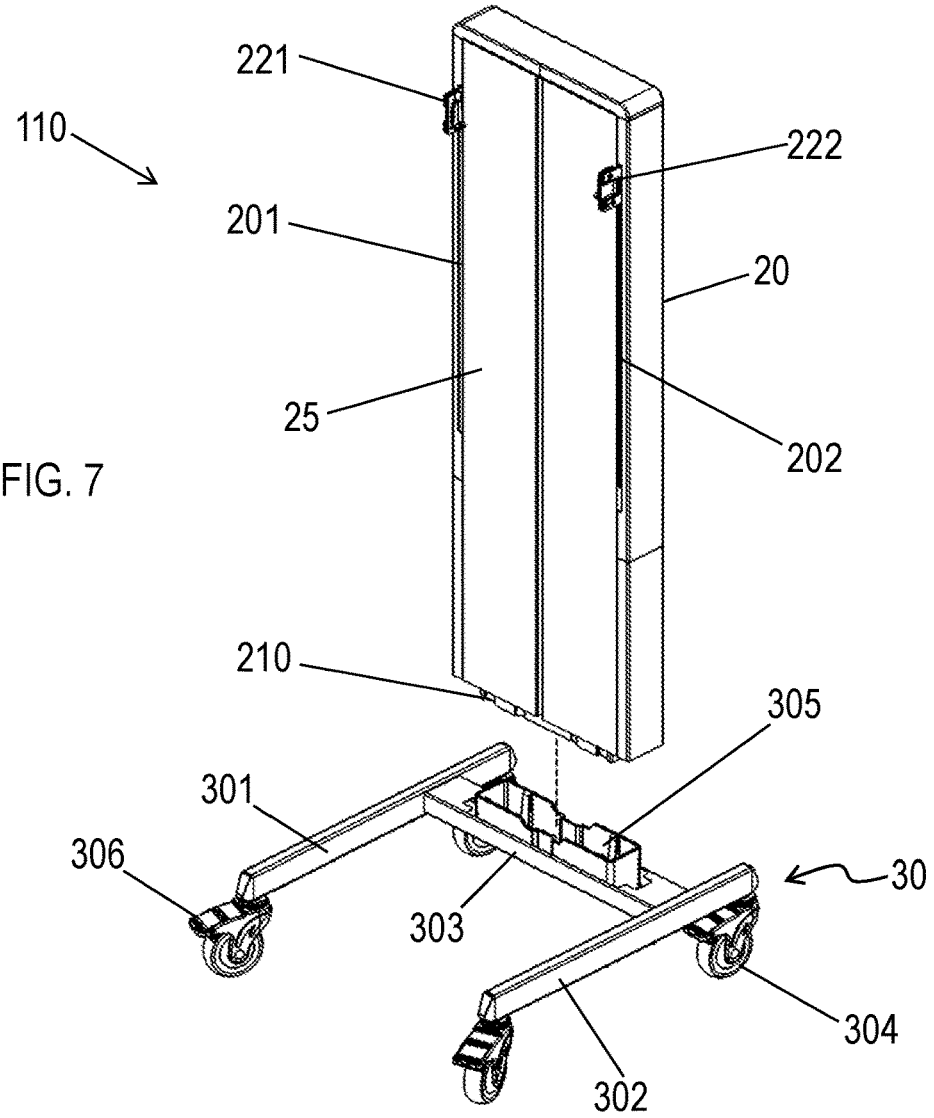
FIG. 7 is an exploded view of a sub-assembly between the wheeled base and the support column of FIG. 3.

FIG. 7 is an exploded view of a sub-assembly between the wheeled base 30 and the support column 20 of FIG. 3. The wheeled base 30 can include a first base member 301 and a second base member 302. The second base member 302 can be parallel to and spaced apart from the first base member 301. The wheeled base 30 can further include a third base member 303. The third base member 303 can be elongated in a transverse direction to the first base member 301 and the second base member 302. The third base member 303 can be coupled to the first base member 301 in one end and coupled to the second base member 302 in the other end. The first base member 301, the second base member 302, and the third base member 303 can be made of a structural material such as aluminum casting, extrusion, sheet metal stamping, or the like.

Figure 8:
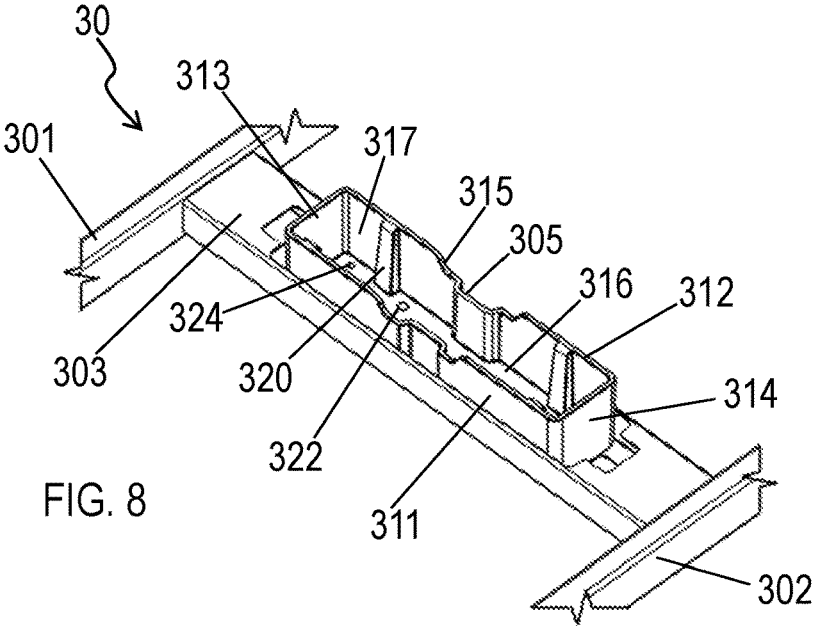
FIG. 8 is a partial perspective view of the wheeled base of FIG. 3.

A housing member 305 can be coupled to the third base member 303 as illustrated in FIG. 8 according to an example configuration of the current disclosure. The housing member 305 can include a first wall 311 and a second wall 312 opposite to the first wall 311. The first wall 311 and second wall 312 can be coupled to each other through a first side wall 313 and a second side wall 314 opposite to the first side wall 313. The housing member 305 can have a hollow section 317. An upper end 315 of the housing member 305 can be open between the first wall 311, the second wall 312, the first side wall 313 and the second side wall 314 to form the hollow section 317 inside the housing member 305. A lower end of the hollow section 317 can be closed by a base 316.

In some example configurations, the housing member 305 can have one or more guides 320 formed on the first wall 311 and the second wall 312. The one or more guides 320 can protrude out of the first wall 311 and second wall 312 into the hollow section 317, and they can be elongated from the base 316 towards the upper end 315 of the housing member 305. The one or more guides 320 can have varying height from the wall they are attached to (e.g., they can be higher proximate to the base 316 compared to their height proximate to the upper end 315 as illustrated in FIG. 8). The one or more guides 320 can be useful to locate the support column 20 relative to the housing member 305 during assembly (as illustrated in FIG. 7). One or more threaded holes 322 and one or more apertures 324 can be formed on the base 316. In some example configurations, the housing member 305 can be made of a structural material such as aluminum casting, extrusion, sheet metal stamping, or the like.

The housing member 305 can be coupled to the wheeled base 30 using one or more mechanical fasteners (e.g., screws, or the like, not shown). The one or more mechanical fasteners can be inserted through one or more apertures (not shown) located on the third base member 303 and threadingly engage with the housing member 305 (e.g., threadingly engage with the one or more threaded holes 322 located on the base 316). In other configurations, the housing member 305 can be formed as an integral part of the third base member 303.

Figure 9:
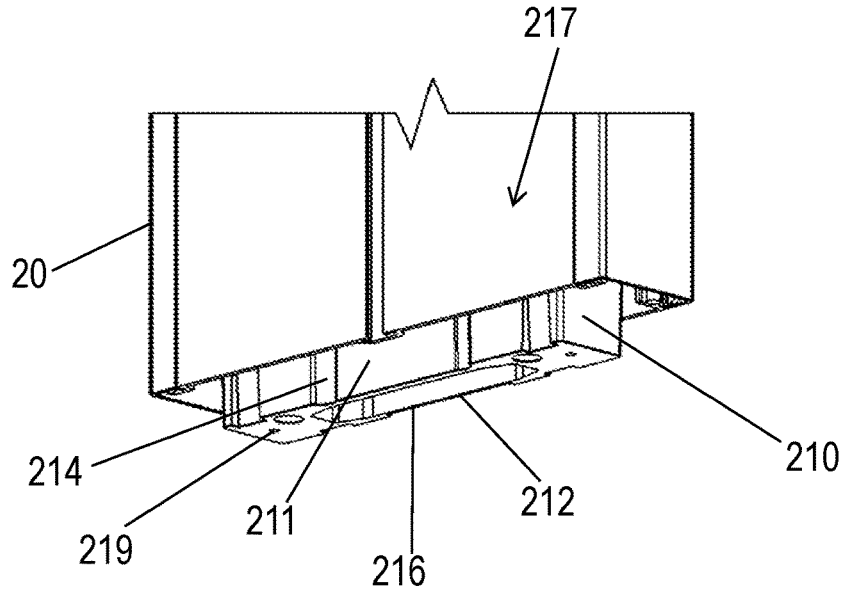
FIG. 9 is a perspective view of the lower end of the support column of FIG. 3.

In some example configurations, a block 210 can be coupled to the lower end of the support column 20 as illustrated in FIG. 9. The block 210 can have a first side 211 and a second side 212 opposite the first side 211. The first side 211 and the second side 212 of the block 210 can be joined by lateral sides. An outside profile of the block 210 can match an inside profile of the hollow section 317 of the housing member 305. The block 210 can be made of a structural material such as aluminum casting, sheet metal stamping, or the like.

In some example configurations, one or more channels 214 can be formed on the first side 211 and the second side 212 of the block 210. The one or more channels 214 can have varying depth (e.g., the one or more channels 214 can be deeper proximate to the lower end 216 of the block 210 as compared to the depth of the one or more channels 214 proximate an upper end 217 of the block 210 away from the lower end 216. The block 210 can further include one or more threaded holes 219 formed on the lower end 216.

The hollow section 317 of the housing member 305 can be configured to receive the block 210 during the sub-assembly of the support column 20 with the wheeled base 30 as illustrated in FIG. 7. The one or more guides 320 located on the housing member 305 can coincide with the one or more channels 214 formed on the block 210. The one or more channels 214 can be configured to receive the one or more guides 320.

The block 210 can be at least partially inserted into the housing member 305. One or more mechanical fasteners (e.g., screws, or the like, not shown) can be coupled to the housing member 305 (e.g., inserted through the one or more apertures 324 shown in FIG. 8) and threadingly engage with the one or more threaded holes 219 to securely fasten the support column 20 to the housing member 305. In other configurations, an autolocking feature (e.g., a detent, a hook, or the like, not shown) can be built into the housing member 305. The auto locking feature can secure the block 210 into the housing member 305 as the block 210 is inserted into the housing member 305. In yet other configurations, the auto-locking feature can temporarily hold the block 210 and the housing member 305 together, and a mechanical fastener (not shown) in cooperation with the autolocking feature, can securely fasten the block 210 to the housing member 305.

In some example configurations, the wheeled base 30 can include one or more sliding or rolling members (e.g., casters, wheels, gliders, or the like). The sliding or rolling members (e.g., one or more wheels 304 of FIG. 6) can provide assistance to transfer a workstation (e.g., the non-powered workstation 110) within a facility. In some configurations, the one or more wheels 304 can include a wheel lock 306. The wheel lock 306 can be selectively activated by the user of the non-powered workstation 110 to prevent any unintentional movement of the wheeled base 30.

Figure 12:
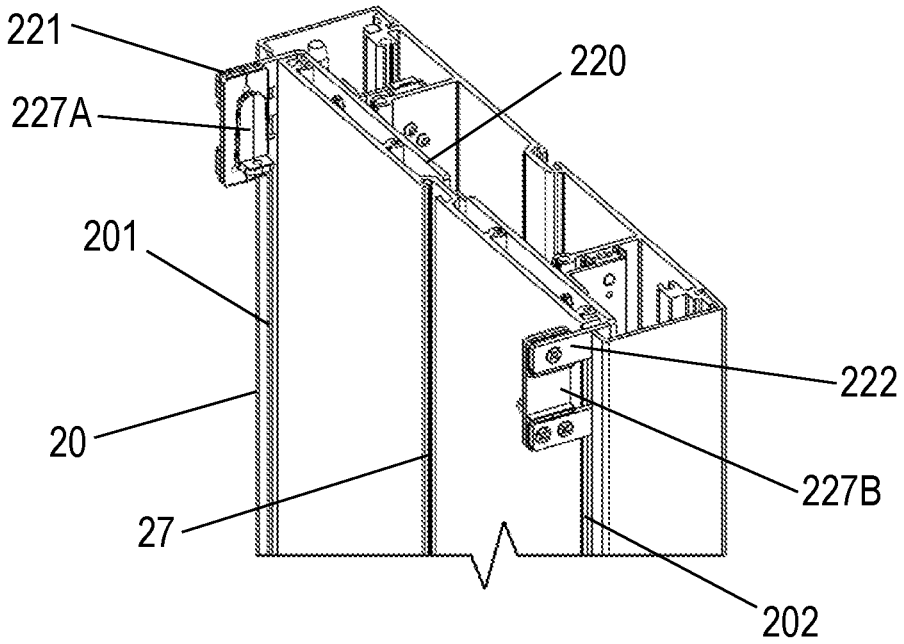
FIG. 12 is a partial cross-sectional view of the support column of FIG. 3.

In some configurations, the support column 20 can include a movable bracket 220 as illustrated in FIG. 12. The movable bracket 220 can be located proximate an upper end of the support column 20. The movable bracket 220 can be slidingly engaged with the support column 20 to travel along at least a portion of the support column 20 in longitudinal direction. One or more arms (e.g., a first arm 221 and a second arm 222 of FIG. 7) can be coupled to the movable bracket 220. In some configurations, the one or more arms can be formed as integral parts of the movable bracket 220.

In some configurations of the workstation (e.g., the non-powered workstation 110), a first opening 201 and a second opening 202 can be formed on the front face 25 of the support column 20. The first opening 201 and the second opening 202 can be elongated in longitudinal direction along at least a portion of the support column 20. The first arm 221 and the second arm 222 can be inserted through the first opening 201 and the second opening 202, respectively, and they extend away from the front face 25 of the support column 20 in a transverse direction. The one or more arms (e.g., a first arm 221 and a second arm 222) can be used to couple the head unit assembly 10 to the movable bracket 220. The movable bracket 220 can be configured to translate along at least a portion of the support column 20 to provide height adjustment for the head unit assembly 10.

Figure 10:
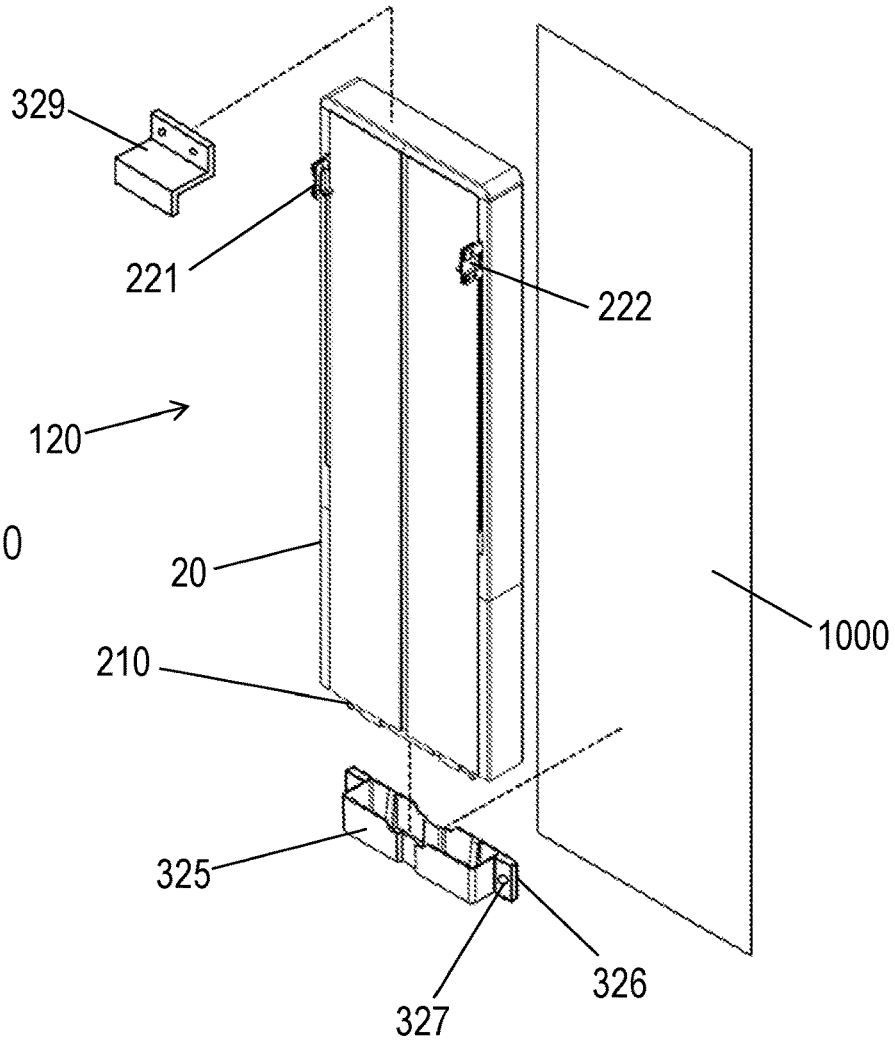
FIG. 10 is an exploded view of a wall mounted workstation according to an example configuration of the current disclosure.

FIG. 10 illustrates exploded view of another example configuration of a workstation (e.g., a wall mounted workstation 120). The wall mounted workstation 120 can be coupled to a wall 1000. The wall mounted workstation 120 can have a housing member 325. The housing member 325 can have similar features of the housing member 305 of FIG. 8 (e.g., the one or more guides 320, the hollow section 317, the base 316, or the like). In some configurations, the housing member 325 can have one or more flanges 326. One or more apertures 327 can be formed on the one or more flanges 326. The housing member 325 can be coupled to the wall 1000. A mechanical fastener (e.g., a wall anchor, a screw, or the like, not shown) can be inserted through the one or more apertures 327 located on the one or more flanges 326 and engage with the wall 1000 to securely fasten the housing member 305 to the wall 1000.

The support column 20 can be coupled to the housing member 325 (e.g., the block 210 can be inserted into the housing member 325 as discussed in previous sections in relation to FIGS. 8-9) to position the support column 20 proximate to the wall 1000. The one or more modules described in this disclosure (e.g., the head unit assembly 10, the rack assembly 50, the display mounting assembly 60, and others) can be coupled to the support column 20 to form the wall mounted workstation 120. In some example configurations, a security bracket 329 can be coupled to the wall 1000 and engage with the support column 20 proximate to its upper end as illustrated in FIG. 10. The security bracket 329 can prevent any undesirable motion (e.g., vibration, tilting, or the like) of the wall mounted workstation 120 during use.

FIG. 11 illustrates yet another example configuration of a workstation 125. The workstation 125 can include a holding bracket 330. The holding bracket 330 can be used to couple the workstation 125 to a structure (e.g., a wall 1000). The holding bracket 330 can have a first face 331 and a second face 332 opposite the first face 331. The second face 332 can be located proximate the wall 1000, and in some configurations, the second face 332 can rest against the wall 1000. The holding bracket 330 can be secured to the wall 1000 using mechanical fasteners including, but not limited to, screws, anchors, or the like. The one or more T-slot inserts 335 can be coupled to the first face 331 of the holding bracket 330. The one or more T-slot inserts 335 can have a matching profile with the rear T-slot 28 located on the rear face 26 of the support column 20. The rear T-slot 28 can be configured to receive the one or more T-slot inserts 335.

The holding bracket can further include a stop surface 333. The stop surface 333 can be located proximate the lower end of the holding bracket 330. The stop surface 333 can extend out of the first face 331 of the holding bracket 330 in a transverse direction.

After the holding bracket 330 is coupled to the wall 1000, the support column 20 can be coupled to the holding bracket 330. The one or more T-slot inserts 335 can be inserted into the rear T-slot 28 starting from the lower end of the rear T-slot 28. The support column 20 can slide relative to the holding bracket towards the stop surface 333 until the support column 20 rests against the stop surface 333. The one or more modules of this disclosure (e.g., the head unit assembly 10, the rack assembly 50, the display mounting assembly 60, and others) can be coupled to the support column 20 to form the workstation 125.

Figure 13:
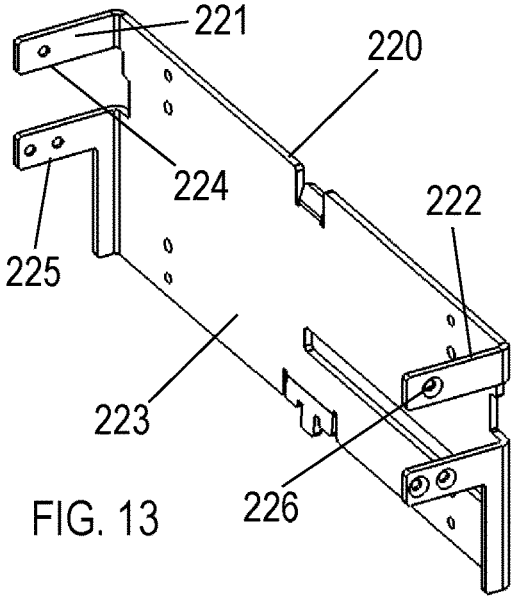
FIG. 13 is a perspective view of a movable bracket of Figure
Figure 29:
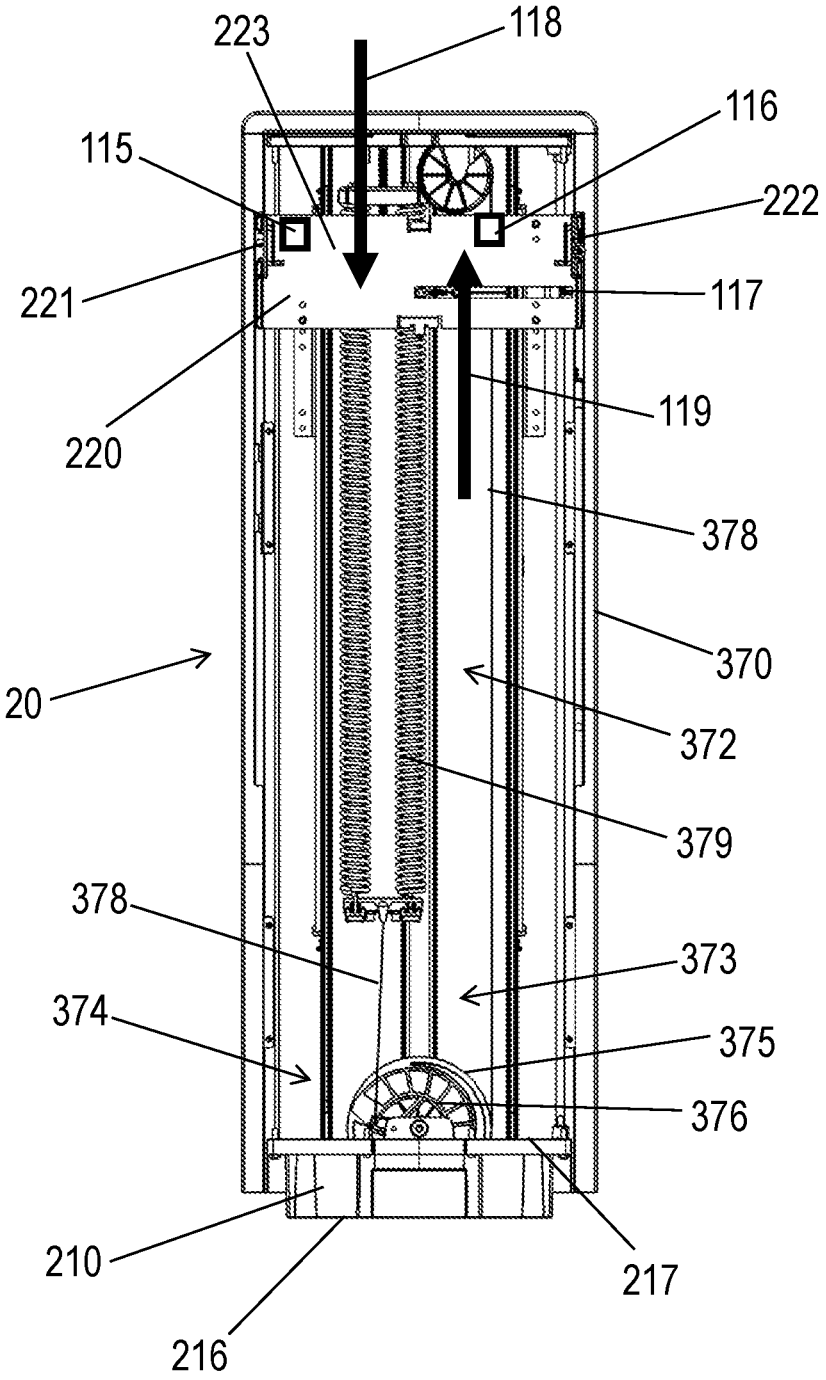
FIG. 29 is a front view of the support column of FIG. 3 according to an example configuration of the current disclosure. The front surface of the support column is removed to display the internal components.

FIG. 12 is a partial cross-sectional view of the support column 20. The upper end of the support column 20 is cut off to make the movable bracket 220 visible. In some example configurations, the movable bracket 220 can be formed in a U-shaped cross-section as illustrated in FIG. 13. The movable bracket 220 can have a base 223, a first arm 221 and a second arm 222. The first arm 221 and the second arm 222 can extend from the base 223 in a transverse direction. In some configurations, the first arm 221 and the second arm 222 can each have an upper portion 224 and a lower portion 225 (as illustrated in FIG. 13). In other configurations, the upper portion 224 and the lower portion 225 can be joined in one arm portion. In some configurations, the base 223 of the movable bracket 220 can be contained inside the support column 20. The base 223 can be coupled to a lift mechanism 372 located inside the support column 20 as illustrated in FIG. 29.

In some configurations, the first arm 221 and the second arm 222 can include one or more through holes 226. The one or more through holes 226 can be useful to attach one or more couplers (e.g., a first coupler 227A and a second coupler 227B) to the movable bracket 220 as illustrated in FIG. 12. In some example configurations, the first coupler 227A and the second coupled 227B can be identical.

Figure 14A:
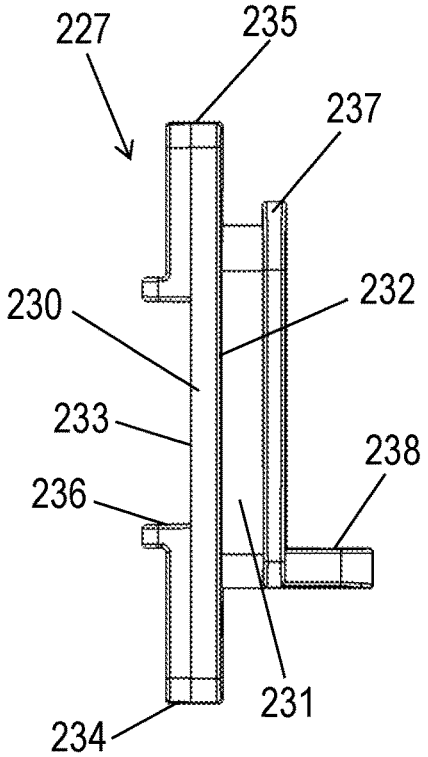
FIG. 14B is a perspective view of the coupler of FIG. 14A.
Figure 14B:
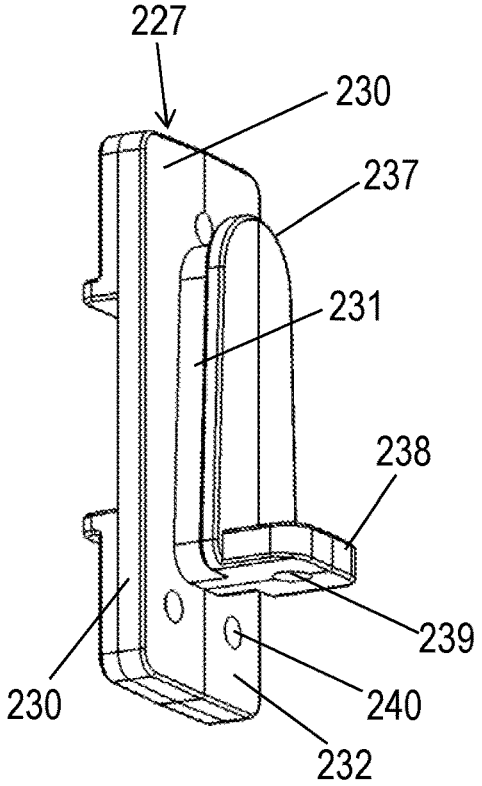

FIGS. 14A-14B are a side view and a perspective view of a coupler 227 according to an example configuration of the current disclosure. The coupler 227 can include a base portion 230 and a raised portion 231. The base portion 230 can have a first surface 232 and a second surface 233 opposite the first surface 232. The base portion 230 can have a width and a height. The height can be larger than the width. The base portion 230 can be elongated from a first end 234 to a second end 235 in height direction.

The raised portion 231 can extend away from the first surface 232 in a transverse direction, and one or more tabs 236 can be formed on the second surface 233. The one or more tabs 236 can be used to key (e.g., locate, register, orient, or the like) the coupler 227 to the first arm 221 and the second arm 222.

The raised portion 231 can be elongated between a lower end and an upper end where the lower end can be proximate to the first end 234 of the base portion 230 and the upper end can be proximate to the second end 235 of the base portion 230. The width of the raised portion 231 can vary between the lower end and the upper end (e.g., the width of the raised portion 231 at the lower end can be larger than the width of the raised portion 231 at the upper end as illustrated in FIG. 14B).

The raised portion 231 can be coupled to the first surface 232 on one end and a ridge 237 can be formed on the other end as illustrated in FIG. 14A. In some example configurations, a flange 238 can be formed on the raised portion 231 proximate to the lower end. The flange 238 can extend away from the raised portion 231. An aperture 239 can be formed on the flange 238, and one or more threaded holes 240 can be formed on the base portion 230.

Figure 15:
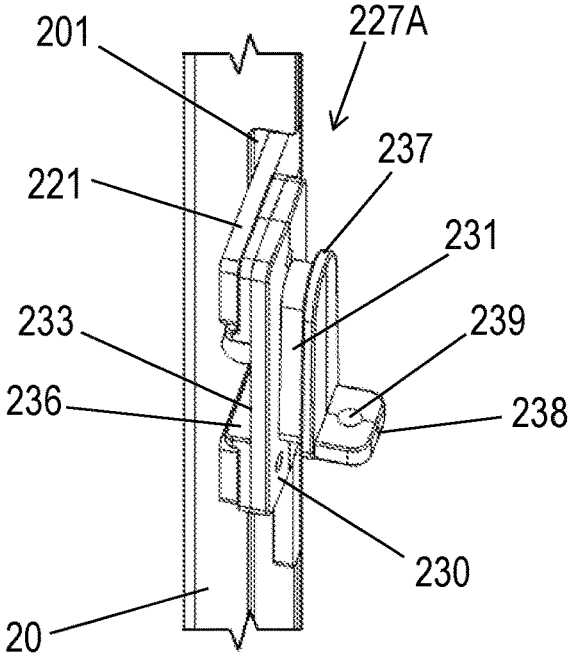
FIG. 15 is a close-up perspective view of a coupler according to another example configuration of the current disclosure.

FIG. 15 is a close-up perspective view of a coupler 227 (e.g., the first coupler 227A of FIG. 12) as attached to an arm (e.g., the first arm 221) of the movable bracket 220. The second surface 233 of the first coupler 227A can be in contact with the first arm 221. The one or more tabs 236 can locate (e.g., key, register, orient, or the like) the first coupler 227A relative to the first arm 221. One or more mechanical fasteners (e.g., screws, or the like, not shown) can be used to securely attach the first coupler 227A to the first arm 221. For example, the one or more mechanical fasteners (not shown) can be inserted through the one or more through holes 226 (shown in FIG. 13) located on the first arm 221, and threadingly engage with the one or more threaded holes 240 (shown in FIG. 14B) located on the first coupler 227A.

Figure 16:
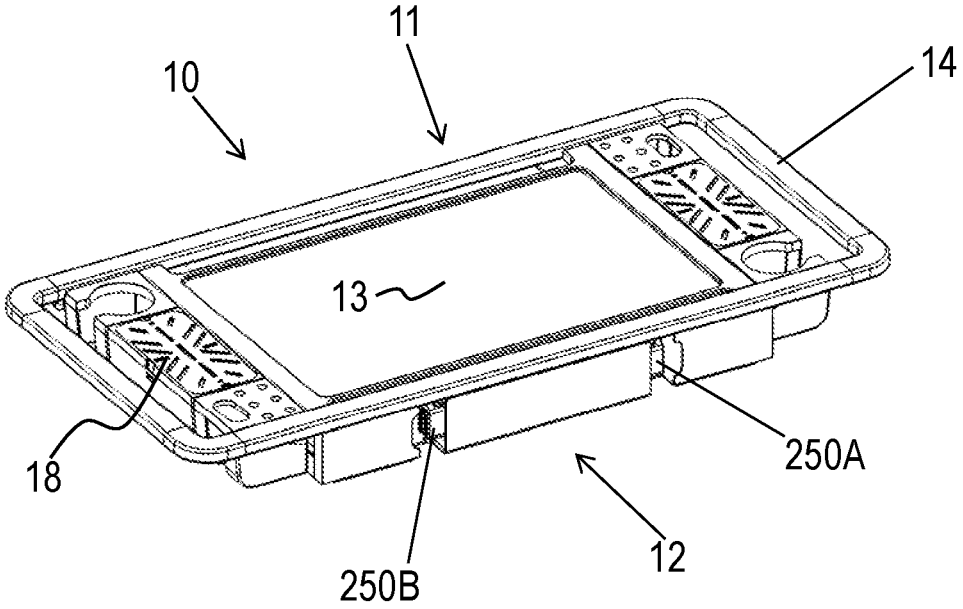
FIG. 16 is a rear perspective view of the head unit assembly of FIG. 3.

FIG. 16 is a rear perspective view of the head unit assembly 10. The head unit assembly 10 can have a front end 11 and a rear end 12. A handle 14 can be coupled to the head unit assembly 10. A first receiver 250A and a second receiver 250B can be coupled to the head unit assembly 10 proximate to the read end 12. The first receiver 250A and the second receiver 250B can be configured to receive the first coupler 227A and the second coupler 227B (shown in FIG. 12), respectively, to removably couple the head unit assembly 10 to the support column 20.

In some example configurations, one or more accessories 18 can be coupled to the head unit assembly 10. The one or more accessories 18 can include, but not limited to, cup holder, scanner holder, printer holder, or the like.

Figure 17:
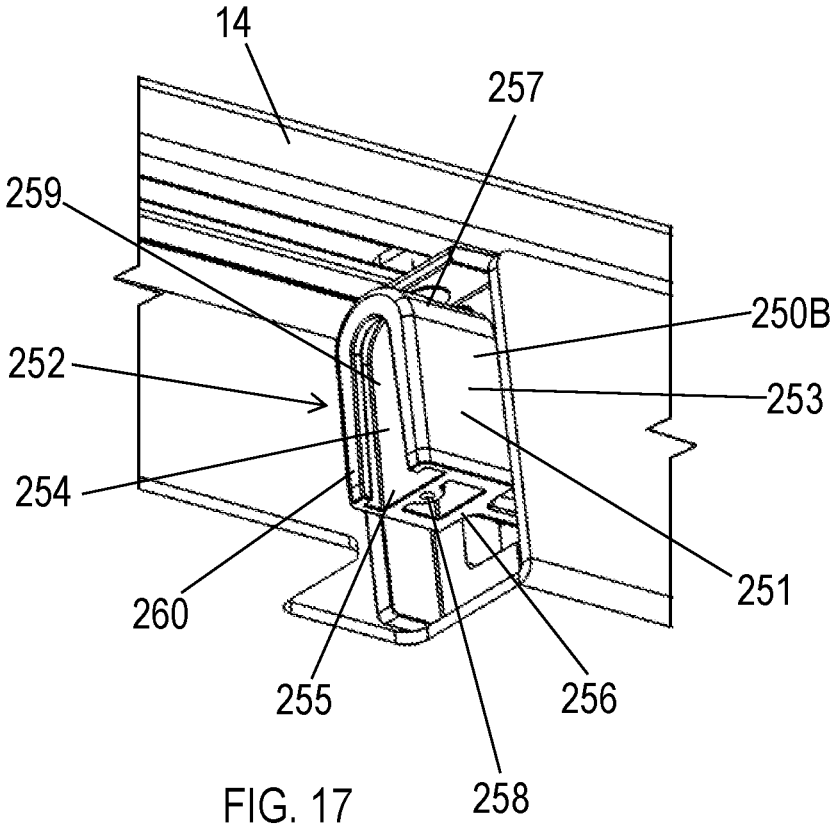
FIG. 17 is a close-up perspective view of a receiver according to another example configuration of the current disclosure.

FIG. 17 is a close-up perspective view of a receiver (e.g., the second receiver 250B of FIG. 16). The second receiver 250B can have a receiver body 251 having a first surface 252, a second surface 253 opposite the first surface 252, and a third surface 254. The third surface 254 can be located on an end of the receiver body 251 and it can be oriented in a transverse direction to the first surface 252 and the second surface 253. The second receiver 250B can be an elongated component between a lower end 256 and an upper end 257.

A pocket 255 can be formed over the third surface 254. The pocket 255 can extend from the lower end 256 towards the upper end 257. In some example configurations, the pocket 255 can have a rectangular cross-section. In other configurations, the pocket 255 can have other cross-sections (e.g., elliptical, round, or the like). A threaded hole 258 can be formed on the lower end 256 of the second receiver 250B.

The pocket 255 can have a height, a width, and a depth. The height of the pocket 255 can extend from the lower end 256 towards the upper end 257 and the width can be in a transverse direction to the height. The depth of the pocket 255 can be perpendicular to the third surface 254. The depth of the pocket 255 can be configured to receive the ridge 237 of the coupler 227.

The receiver (e.g., the second receiver 250B) can further include a receiver opening 259 at an outer surface of the pocket 255. A lip 260 can be formed on at least a portion of an outer end of the receiver opening 259. The receiver opening 259 can be configured to receive the raised portion 231 of the coupler 227. The ridge 237 can be inserted into the pocket 255. The ridge 237 can be trapped behind the lip 260 when the coupler 227 is inserted into the receiver opening 259.

In some example configurations, the width of the pocket 255 and the receiver opening 259 can decrease in size as the pocket 255 extends from the lower end 256 towards the upper end 257.

In the assembled configuration of the head unit assembly 10 with the support column 20 (e.g., the first coupler 227A and the second coupler 227B can be inserted in to the first receiver 250A and the second receiver 250B, respectively), the aperture 239 located on the first coupler 227A and the second coupler 227B can be concentric with the threaded hole 258 located on the first receiver 250A and the second receiver 250B, respectively. A mechanical fastener (e.g., a screw, or the like, not shown) can be inserted through the apertures 239 and engage with the threaded holes 258 to secure the receiver on to the coupler (e.g., to secure the first receiver 250A on to the first coupler 227A, and to secure the second receiver 250B on to the second coupler 227B).

Figure 18:
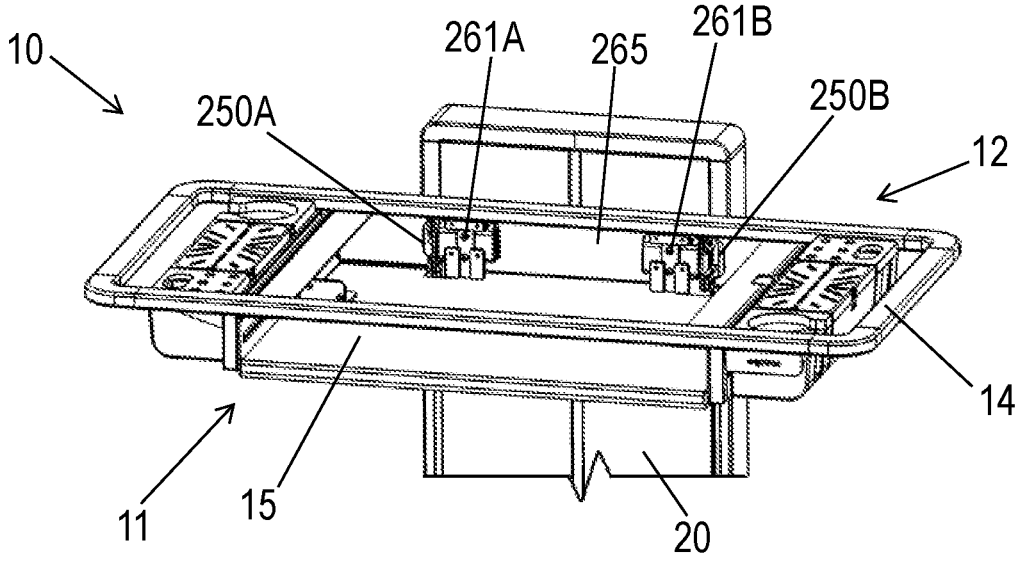
FIG. 18 is a perspective view of the sub-assembly between the head unit assembly and the support column of FIG. 3.

FIG. 18 is a front perspective view of the sub-assembly between the head unit assembly 10 and the support column 20. The head unit assembly 10 can include a first hook 261A, a second hook 261B, and a head unit chassis 265. The head unit chassis 265 can be coupled to the first hook 261A and the second hook 261B. The first hook 261A and the second hook 261B can be rotatingly coupled to the first receiver 250A and the second receiver 250B. One or both of the first hook 261A and the second hook 261B can be manipulated (e.g., rotated, pushed, pulled, or the like) relative to the first receiver 250A or the second receiver 250B, respectively, to level the head unit chassis 265 after it is coupled to the support column 20.

Construction of the first hook 261A can be similar to the construction of the second hook 261B. Similarly, construction of the first receiver 250A can be similar to the second receiver 250B. For simplicity, the first hook 261A and the second hook 261B will be called the hook 261, and the first receiver 250A and the second receiver 250B will be called the receiver 250 in the following sections to explain their construction and interaction.

Figure 19:
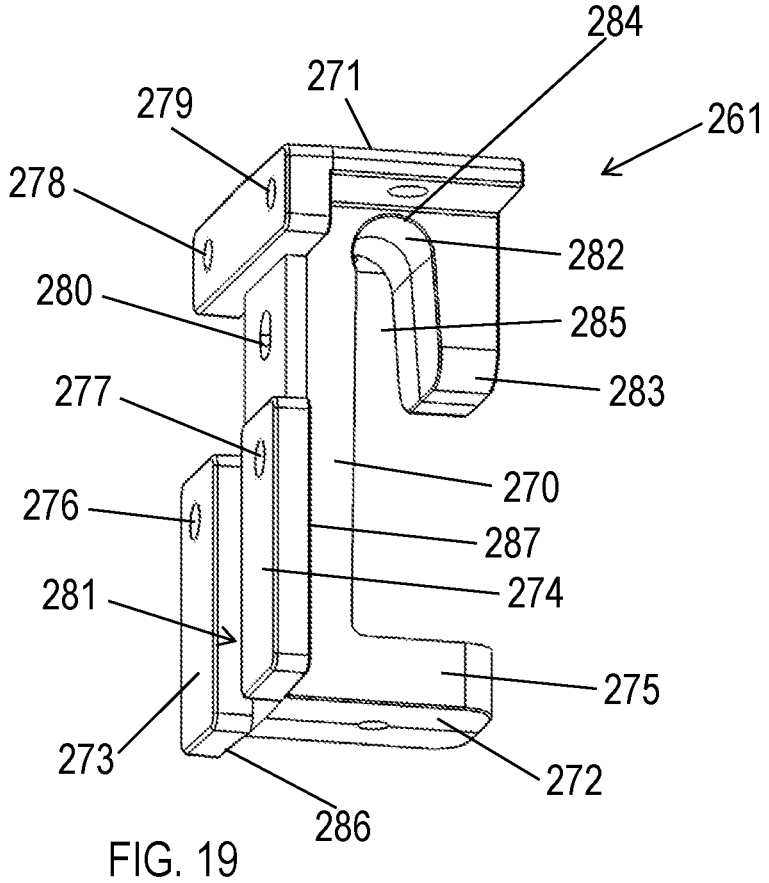
FIG. 19 is a perspective view of a hook according to another example configuration of the current disclosure.

FIG. 19 is a perspective view of a hook 261 (e.g., the first hook 261A or the second hook 261B of FIG. 18) according to an example configuration of the current disclosure. The hook 261 can have a hook body 270. The hook body 270 can be elongated between a first end 271 and a second end 272. A first flange 273 and a second flange 274 can be coupled to the hook body 270 proximate to the second end 272. In some example configurations, the hook 261 can further include a third flange 275. The third flange 275 can be coupled to the hook body 270 proximate to the second end 272. The third flange 275 can be elongated in a transverse direction from the hook body 270.

A first threaded hole 276 and a second threaded hole 277 can be formed on the first flange 273 and the second flange 274, respectively. The hook 261 can further include a third threaded hole 278 and a fourth threaded hole 279 located proximate to the first end 271 of the hook 261. A first aperture 280 and a second aperture 281 formed on the hook body 270. The first aperture 280 and the second aperture 281 can be elongated holes formed on the hook body 270 proximate to the first end 271 and the second end 272, respectively.

The hook 261 can further include a groove 282 and an overhang 283. The groove 282 can be formed in a circular profile having a groove radius 284. The groove 282 can connect the overhang 283 with the hook body 270 to form a channel 285 proximate to the first end 271 of the hook 261. The channel 285 can be configured to receive at least a portion of the receiver 250.

Figure 20:
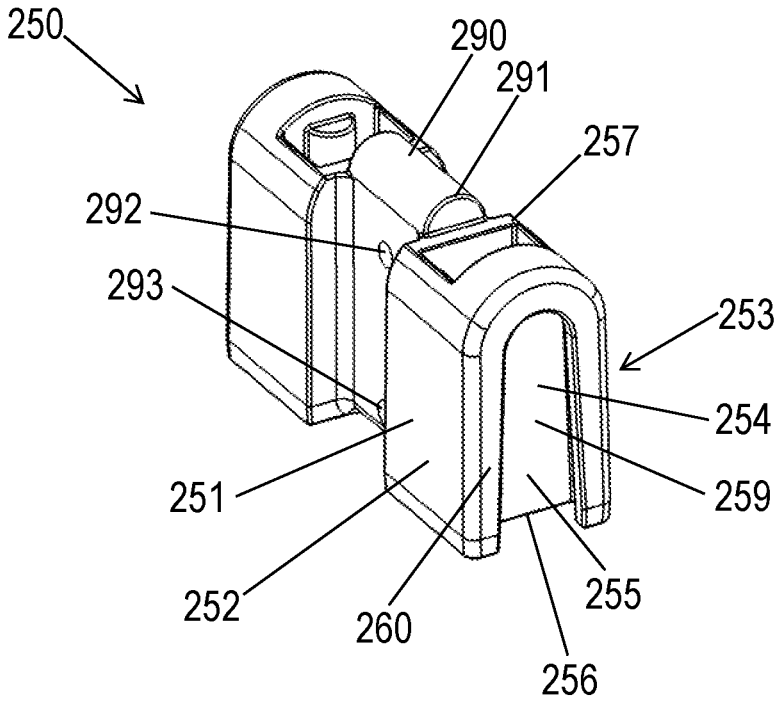
FIG. 20 is a perspective view of a receiver according to another example configuration of the current disclosure.

FIG. 20 is a perspective view of a receiver 250 (e.g., the first receiver 250A or the second receiver 250B of FIG. 18). The receiver 250 can have a receiver body 251 having a lower end 256 and an upper end 257. A bead 290 can be formed on the receiver body 251 proximate to the upper end 257. The bead 290 can be formed in a circular profile having a bead radius 291. The bead radius 291 can be smaller than the groove radius 284. The bead 290 can be configured to fit inside the groove 282. One or more threaded holes (e.g., a fifth threaded hole 292, and a sixth threaded hole 293) can be formed on the receiver body 251.

Figure 21:
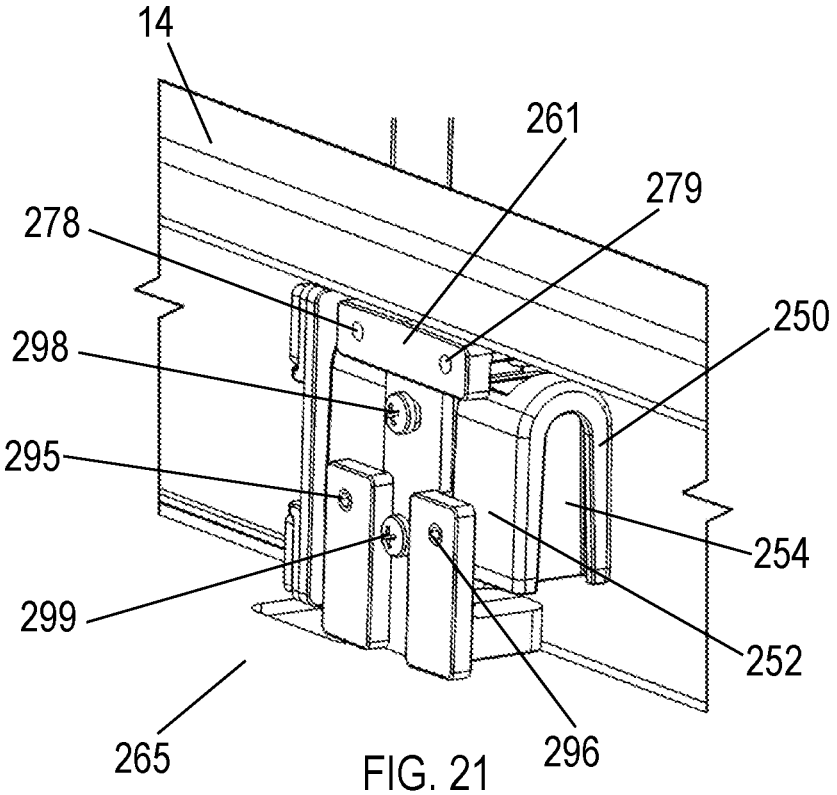
FIG. 21 is a close-up view of a sub-assembly between the hook of FIG. 19 and the receiver of FIG. 20 according to another example configuration of the current disclosure.
Figure 22:
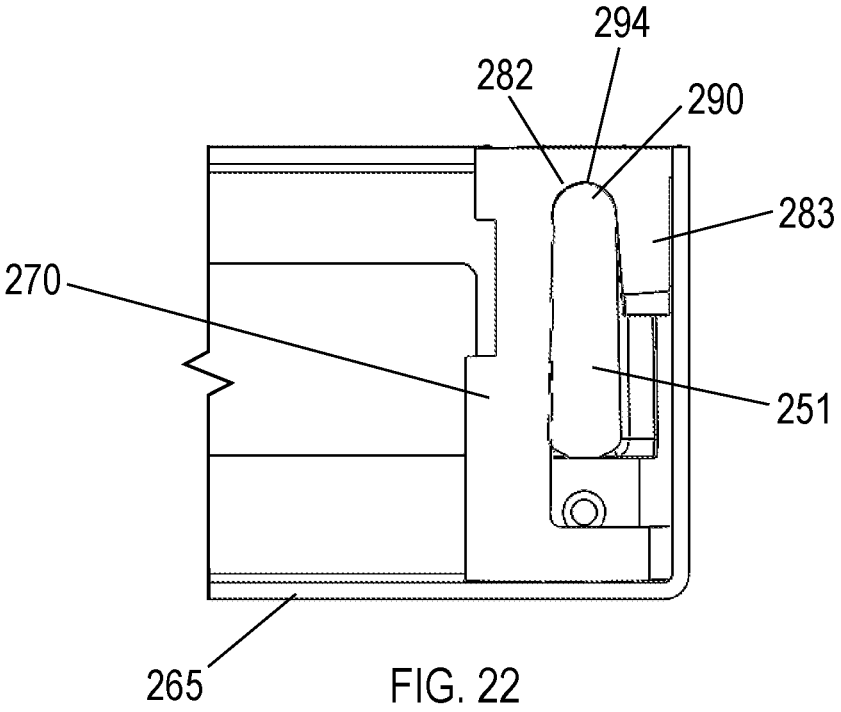
FIG. 22 is a cross-sectional view of the sub-assembly of FIG. 21 between the hook and the receiver.

FIGS. 21 and 22 are a close-up perspective view and a cross-sectional view, respectively, of the coupling between a hook 261 and a receiver 250 according to an example configuration of the current disclosure. The channel 285 formed between the hook body 270 and the overhang 283 can be configured to receive at least a portion of the receiver body 251. At least a portion of the receiver body 251 can be inserted into the channel 285 until a contact is established between the groove 282 and the bead 290. The hook 261 can be configured to rotate relative to the receiver 250 over an interface surface 294 between the groove 282 and the bead 290.

Figure 23:
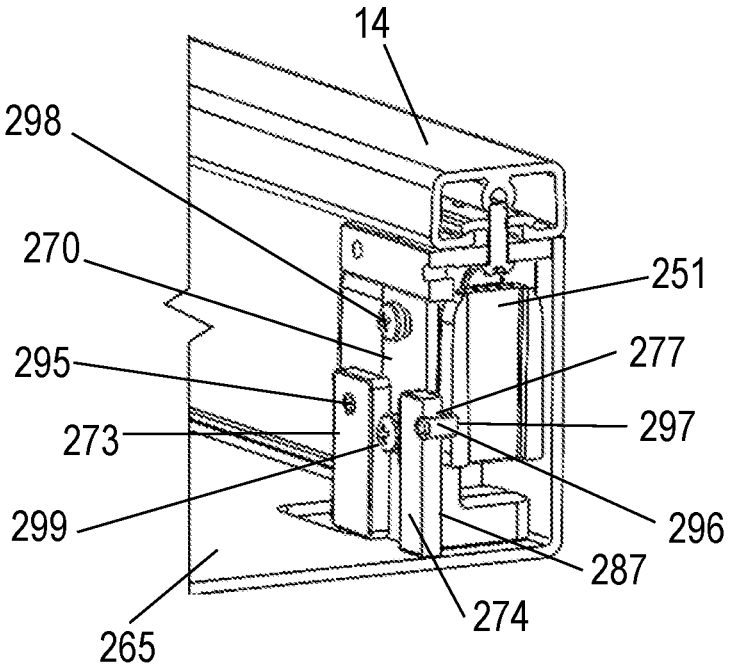
FIG. 23 is another cross-sectional view of the sub-assembly of FIG. 21 between the hook and the receiver.

FIG. 23 is a cross-sectional view of the coupling between the hook 261 and the receiver 250. In some example configurations, a first set screw 295 and a second set screw 296 can threadingly engage with the first threaded hole 276 and the second threaded hole 277, respectively. The cross-section shown in FIG. 23 is the vertical cross-section passing through a centerline of the second set screw 296.

The first set screw 295 and the second set screw 296 can extend out of the rear face 286 of the first flange 273 and the rear face 287 of the second flange 274, respectively. The user of the workstation can rotate the first set screw 295 and the second set screw 296 to adjust the lengths of the extended sections of the first and the second set screws behind the rear faces of the first flange 273 and the second flange 274.

The tip (not shown) of the first set screw 295 and the tip 297 of the second set screw 296 can contact the first surface 252 of the receiver body 251. As the lengths of the extended sections of the first set screw 295 and the second set screw 296 increase, they can push the hook body 270 away from the receiver body 251, and thus, rotate the hook 261 around the bead 290 of the receiver 250 and change an angle of the hook 261 relative to the receiver 250. Therefore, one or both of the first set screw 295 and the second set screw 296 located on the first hook 261A and the second hook 261B can be rotated to change an angle of one or both of the first hook 261A and the second hook 261B to level (e.g., make horizontal, or the like) the head unit chassis 265.

Figure 24:
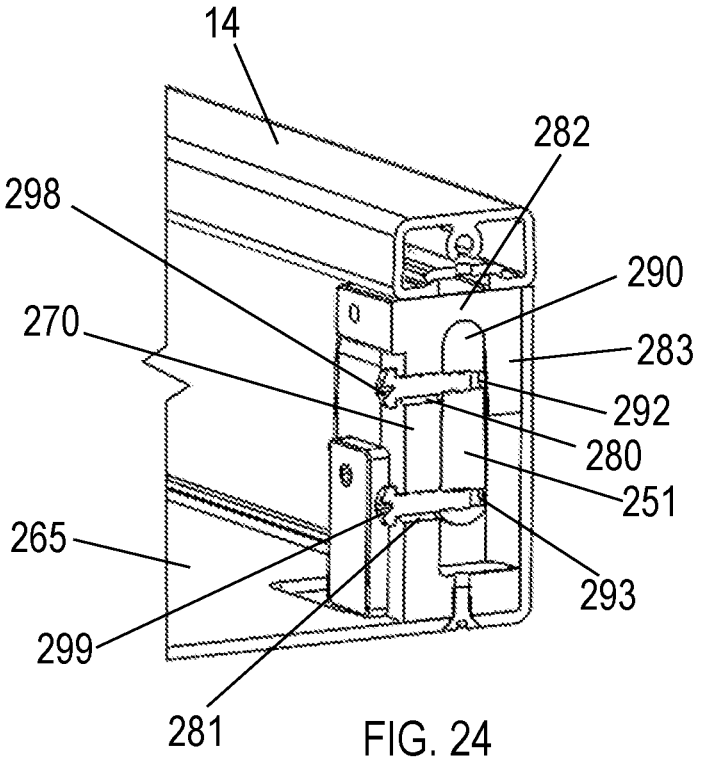
FIG. 24 is yet another cross-sectional view of the sub-assembly of FIG. 21 between the hook and the receiver.

FIG. 24 is a cross-sectional view of the coupling between the hook 261 and the receiver 250. In some example configurations, the workstation assembly can include a first screw 298 and a second screw 299. The first screw 298 can be inserted through the first aperture 280 and it can be threadingly engaged with the fifth threaded hole 292. The second screw 299 can be inserted through the second aperture 281 and it can be threadingly engaged with the sixth threaded hole 293. The cross-section shown in FIG. 24 is the vertical cross-section passing through a centerline of the first screw 298 and the second screw 299. The first aperture 280 and the second aperture 281 are elongated holes in vertical direction. The first aperture 280 and the second aperture 281 allow the angle of the hook body 270 change relative to the receiver body 251 by turning the set screws relative to the hook body 270 as discussed above. During the angle adjustment, the first screw 298 and the second screw 299 can be loosely connected to the receiver body 251. After the angle of the hook body 270 is changed to level the head unit chassis 265, the first screw 298 and the second screw 299 can be tightened to securely couple the hook 261 to the receiver 250.

Figure 25:
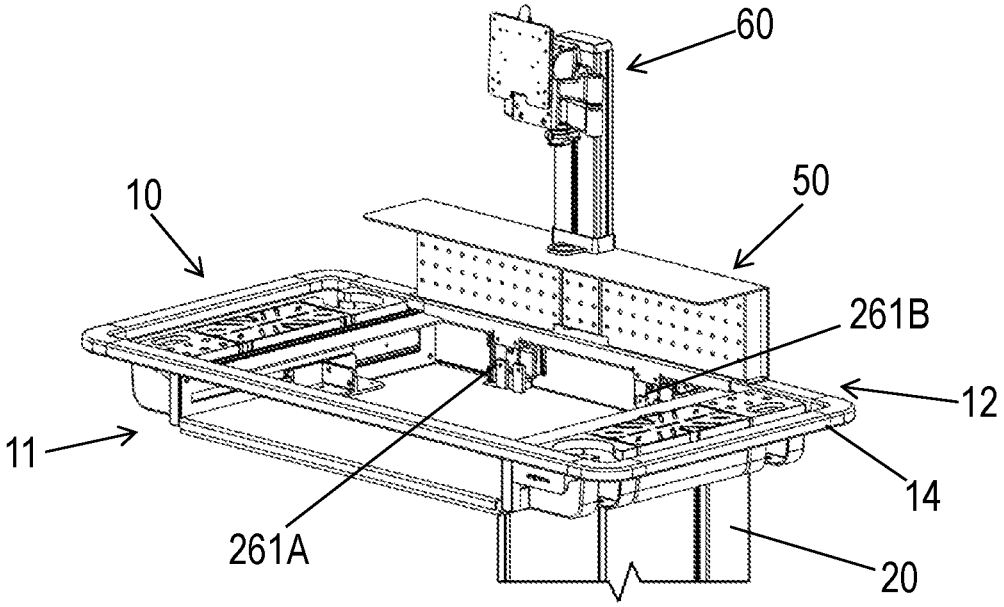
FIG. 25 is a partial perspective view of the workstation of FIG. 1.

FIG. 25 is a perspective view of the head unit assembly 10 according to an example configuration of the current disclosure. The head unit assembly 10 can be coupled to the support column 20 as discussed in earlier sections. A rack assembly 50 can be coupled to the rear end of the head unit assembly 10.

Figure 26:
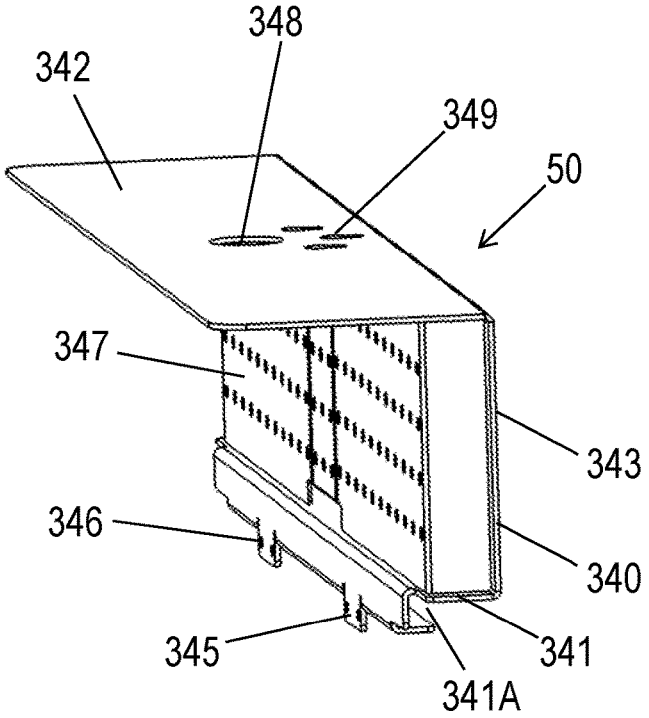
FIG. 26 is a perspective view of the shelf assembly of FIG. 3.

FIG. 26 is a perspective view of a rack assembly 50 of FIG. 25. The rack assembly 50 can have a rack frame 340. The rack frame 340 can be formed from one or more known engineering materials including, but not limited to, stamped sheet metal, die cast, injection molding. The rack frame 340 can have a base portion 341, an upper portion 342, and a middle portion 343 coupled between the base portion 341 and the upper portion 342.

In some example configurations, the base portion 341 can be formed in a U-shaped cross-section 341A. A portion of the handle 14 can be located inside the U-shaped cross-section 341A. One or more strips 345 can be formed on the base portion 341. The one or more strips 345 can include one or more first apertures 346. The one or more strips 345 can be useful to secure the rack assembly 50 to the head unit assembly 10.

In an assembled configuration of the rack assembly 50 with the head unit assembly 10 as illustrated in FIG. 25, the one or more first apertures 346 can be concentric with one or more of the third threaded hole 278 and the fourth threaded hole 279 (shown in FIG. 21). One or more known mechanical fasteners (e.g., screws, or the like, not shown) can be inserted through the one or more first apertures 346 and threadingly engage with the one or both of the third threaded hole 278 and the fourth threaded hole 279. The one or more fasteners can be tightened to secure the rack assembly 50 on the head unit assembly 10.

In some example configurations, the middle portion 343 can include a peg board 347. The peg board 347 can be useful to couple one or more accessories (not shown) to the head unit assembly 10.

In some example configurations, the upper portion 342 can extend from the middle portion 343 in a transverse direction (e.g., it can extend in a horizontal direction). The upper portion 342 can include a second aperture 348 and one or more keyholes 349. The second aperture 348 and the one or more keyholes 349 can be useful to couple the display mounting riser 62 to the rack assembly 50.

Figure 27:
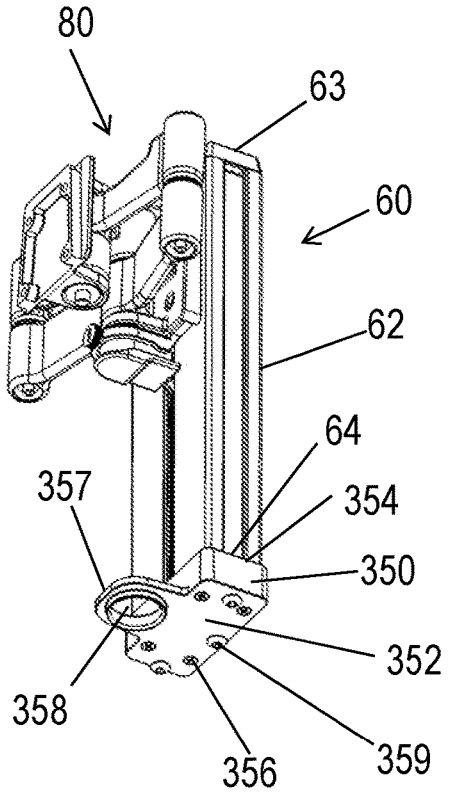
FIG. 27 is a perspective view of the display mounting assembly of FIG. 3.

FIG. 27 is a perspective view of the display mounting assembly 60 of FIG. 1 according to an example configuration of the current disclosure. The display mounting assembly 60 can include a display mounting riser 62 and an arm assembly 80. The display mounting riser 62 can be elongated in vertical direction between an upper end 63 and a lower end 64. A riser base 350 can be coupled to the lower end 64 of the display mounting riser 62, and the arm assembly 80 can be coupled to the display mounting riser 62 proximate to its upper end 63. The arm assembly 80 can be configured to travel at least a portion of the display mounting riser 62 between the upper end 63 and the lower end 64.

The riser base 350 can have a bottom surface 352 and an upper surface 354. The upper surface 354 can have a hollow section (not shown) to receive the lower end 64 of the display mounting riser 62. The lower end 64 can be at least partially located inside the hollow section on the riser base 350. The display mounting riser 62 can be secured to the riser base using one or more first mechanical fasteners 356 (e.g., one or more screws). In some example configurations, the riser base 350 can be formed as an integral part of the display mounting riser 62.

The riser base 350 can have an extended portion 357. A through hole 358 can be formed on the extended portion 357. One or more second mechanical fasteners 359 (e.g., one or more screws) can be coupled to the bottom surface 352. In the assembled configuration, the through hole 358 can be concentric with the second aperture 348 of the rack assembly 50, and the one or more second mechanical fasteners 359 can engage with the one or more keyholes 349 located on the rack assembly 50. Initially, the one or more second mechanical fasteners 359 can be loosely attached to the riser base 350. After the display mounting riser 62 coupled to the rack assembly 50 (e.g., after the one or more second mechanical fasteners 359 engaged with the one or more keyholes 349) as illustrated in FIG. 25, the one or more second mechanical fasteners 359 can be tightened to secure the display mounting riser 62 on the rack assembly 50.

Figure 28:
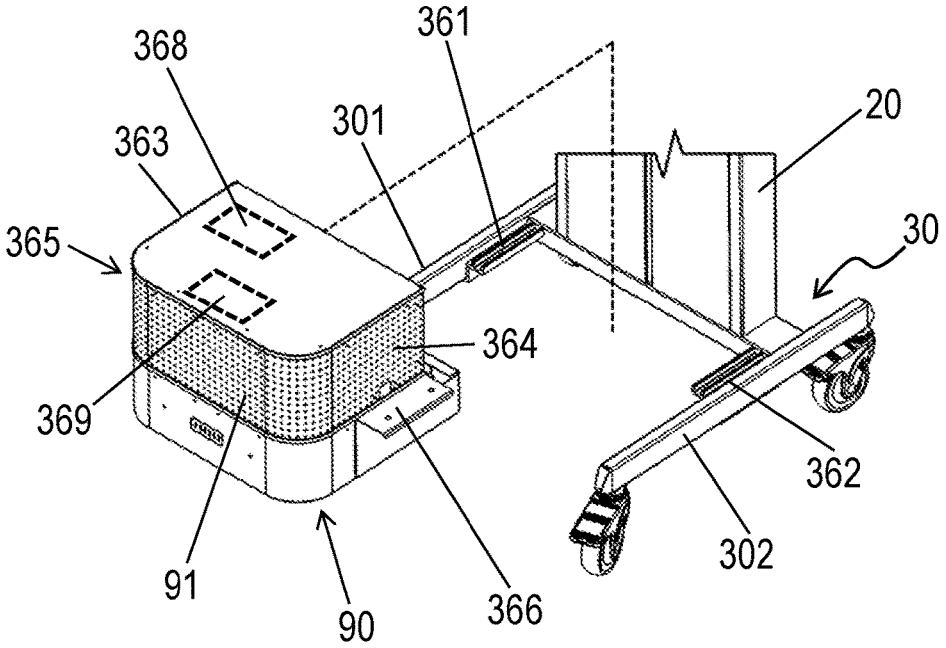
FIG. 28 is an exploded view of the sub-assembly between the wheeled base and the power system housing according to an example configuration of the current disclosure.

FIG. 28 is an exploded view of the sub-assembly between the wheeled base 30 and the power system housing 91 according to an example configuration of the current disclosure. A first seat 361 and a second seat 362 can be coupled to the wheeled base 30. The first seat 361 and the second seat 362 can be fixedly attached to the first base member 301 and the second base member 302, respectively, via various methods including, but not limited to, welding, fastening using screws, or the like. In other configurations, the first seat 361 and the second seat 362 can be formed as an integral part of the first base member 301 and the second base member 302, respectively. The first seat 361 and the second seat 362 can be useful to couple the power system housing 91 to the wheeled base 30.

Figure 42A:
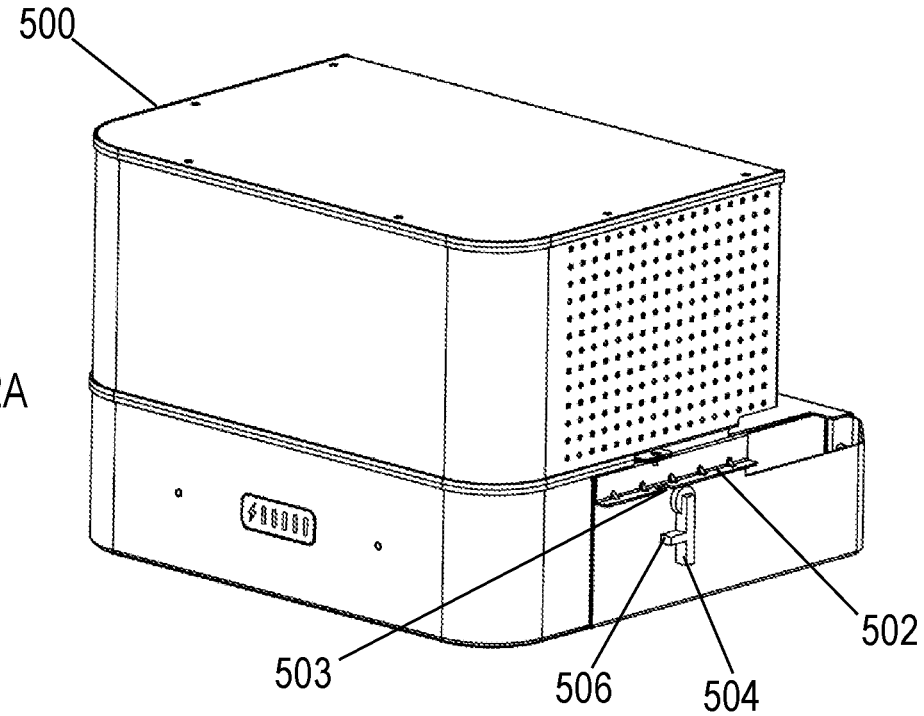
FIG. 42A is a perspective view of an example power system housing of FIG. 37 in unlocked configuration.
Figure 42B:
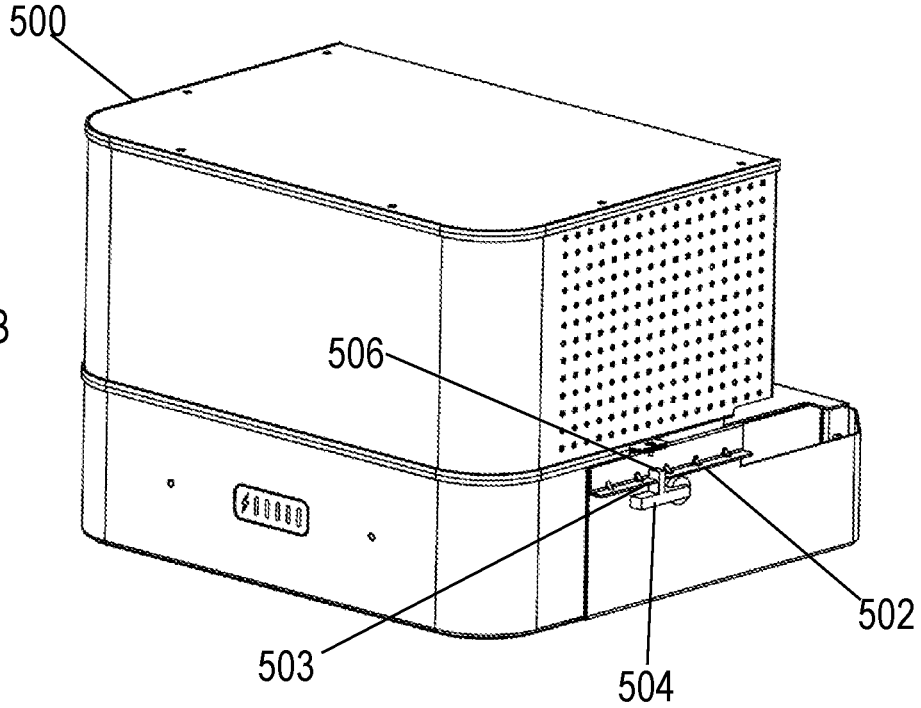
FIG. 42B is a perspective view of an example power system housing of FIG. 37 in locked configuration.

The power system housing 91 can have a first side 363 and a second side 364 opposite the first side 363. A first limb 365 can be coupled to the first side 363, and a second limb 366 can be coupled to the second side 364. In the assembled configuration as illustrated in FIG. 1, the first limb 365 can overlap with the first seat 361, and the second limb 366 can overlap with the second seat 362. In some example configurations, the first limb 365 and the second limb 366 can be fixedly attached to the first seat 361 and the second seat 362, respectively, by means of one or more known mechanical fasteners (e.g., one or more screws, one or more detents, or the like, not shown). In other configurations, the power system housing 90 can be coupled to the wheeled base 30 using one or more lock mechanisms (e.g., one or more cam locks, one or more levers, or the like, as illustrated in FIGS. 42A-42B).

The workstation 100 of FIG. 1 can include a power system 90. The power system 90 can include one or more batteries 368 and a power module 369. The one or more batteries 368 and the power module can be located inside the power system housing 91. The power module 369 can include an AC/DC power supply, an inverter, a controller logic circuit, and battery charging circuit among other things. The power module 369 can provide power to one or more electrical components (e.g., a scanner, a computer, one or more displays, a printer, or the like) coupled to the workstation 100.

FIG. 29 illustrates a front view of the support column 20 of FIG. 1 according to an example configuration of the current disclosure. Portions of the support column 20 (e.g., a front face 25) have been hidden for clarity. The support column 20 can include a support column frame 370, a block 210, a movable bracket 220 and a lift mechanism 372. The block 210 can be coupled to the lower end of the support column frame 370. The block 210 can be useful to couple the support column 20 to a structure (e.g., a wheeled base, wall, or the like).

The lift mechanism 372 can be coupled between the support column frame 370 and the movable bracket 220. The lift mechanism 372 can assist the translation of the movable bracket 220 relative to the support column frame 370. In some example configurations, the lift mechanism 372 can include a weight counterbalance mechanism 373. The weight counterbalance mechanism 373 can be configured to lift at least a portion of the combined weights attached to the movable bracket 220.

The weight counterbalance mechanism 373 can include a wheel assembly 374. The wheel assembly 374 can be rotatingly coupled to the support column frame 370. The wheel assembly 374 can rotate relative to the support column frame 370 around a horizontal axis during the translation of the movable bracket 220. In some example configurations, the wheel assembly 374 can include a pulley 375 and a rotary cam 376 fixedly attached to the pulley.

Figure 30:
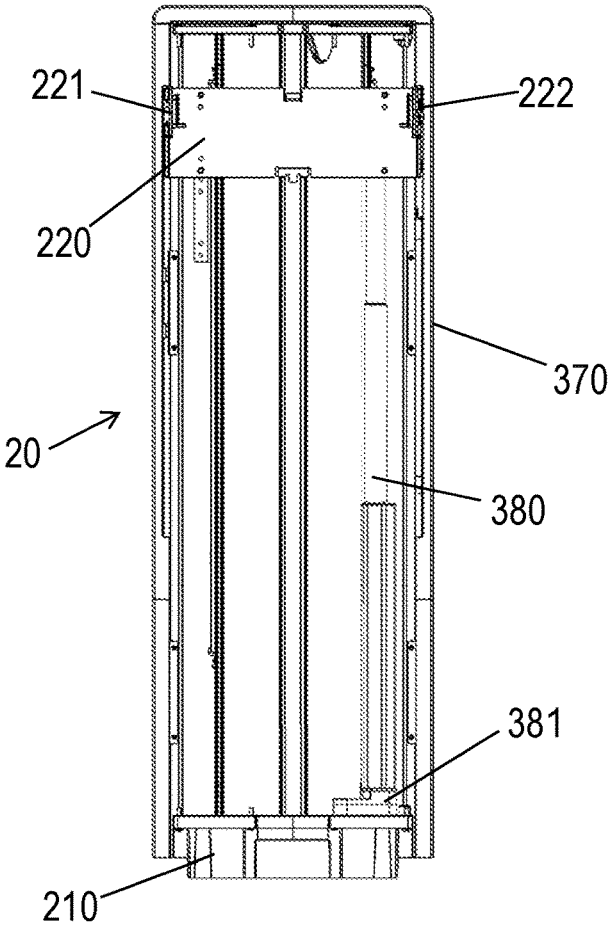
FIG. 30 is a front view of the support column of FIG. 3 according to another example configuration of the current disclosure. The front surface of the support column is removed to display the internal components.

In some example configurations, one or more tensile members 378 (e.g., a cable, a rope, or the like) can engage with the wheel assembly 374. Translation of the movable bracket 220 can activate (e.g., move, rotate, or the like) the one or more tensile members 378 and the wheel assembly 374. The one or more tensile members 378 can be coupled to a biasing member 379 (e.g., a spring, or the like). The biasing member 379 can be activated (e.g., stretched, expanded, retracted, compressed, or the like) when the movable bracket 220 translates relative to the support column frame 370. In an example, the lift mechanism 372 can be similar to (and can incorporate components of) the lift mechanism described in commonly assigned U.S. Pat. No. 11,071,377 to Lindblad et al., entitled "HEIGHT ADJUSTABLE PLATFORMS AND ASSOCIATED MECHANISMS", which is hereby incorporated by reference herein in its entirety FIG. 30 is front view of another example configuration of the current disclosure. Portions of the support column 20 (e.g., a front face 25) have been hidden for clarity. In some configurations, the support column 20 can include a linear actuator 380. The linear actuator 380 can be coupled between the support column frame 370 and the movable bracket 220. The linear actuator 380 can be used for adjusting a height of the movable bracket 220 relative to the support column frame 370. The linear actuator 380 can be coupled to an electric motor 381. In some example configurations, the electric motor can be housed inside the block 210. In other configurations, the electric motor 381 can be directly coupled to the support column frame 370. The electric motor 381 can drive the linear actuator 380.

One or more control buttons (not shown) can be used to activate the linear actuator 380. In some configurations, the one or more control buttons can be located on the head unit assembly 10 close to the handle 14 (e.g., proximate to a first handle member 391 of FIG. 32). In other configurations, the one or more control buttons can be located on a graphical user interface shown on a display 442 (shown in FIG. 37). The one or more control buttons can be operationally coupled to the electric motor 381. Once activated through the one or more control buttons, the electric motor 381 can drive the linear actuator 380 to adjust a height of the movable bracket 220.

FIG. 31 is a perspective view of a workstation 130 according to another example configuration of the current disclosure. The workstation 130 can include a first display mounting assembly 60A and a second display mounting assembly 60B. In some configurations, the first display mounting assembly 60A and the second display mounting assembly 60B can be coupled to the rack assembly 50. In other configurations, the first display mounting assembly 60A and the second display mounting assembly 60B can be directly coupled to the head unit assembly 10.

The first display mounting assembly 60A and the second display mounting assembly 60B can be useful to hold a first display (not shown) and a second display (not shown) above the worksurface 13. The first display and the second display can be similar to the display 442 (shown in FIG. 37). In some configurations, one or both of the first display mounting assembly 60A and the second display mounting assembly 60B can include a lift mechanism (e.g., similar to the second height adjustment mechanism 499 shown in FIG. 41) to adjust a position of the one or both of the first display and the second display relative to the worksurface 13. In other configurations, the first display mounting assembly 60A and the second display mounting assembly 60B can be stationary (e.g., a pole without a lift mechanism).

In some example configurations, the first display mounting assembly 60A and the second display mounting assembly 60B can be independent of each other. For example, the first display coupled to the first display mounting assembly 60A and the second display coupled to the second display mounting assembly 60B can be independently height adjustable. In other configurations, the first display mounting assembly 60A and the second display mounting assembly 60B can be coupled to each other using a crossbar (not shown). In this configuration, a height of two displays coupled to the first display mounting assembly 60A and the second display mounting assembly 60B can be adjusted simultaneously.

Figure 32:
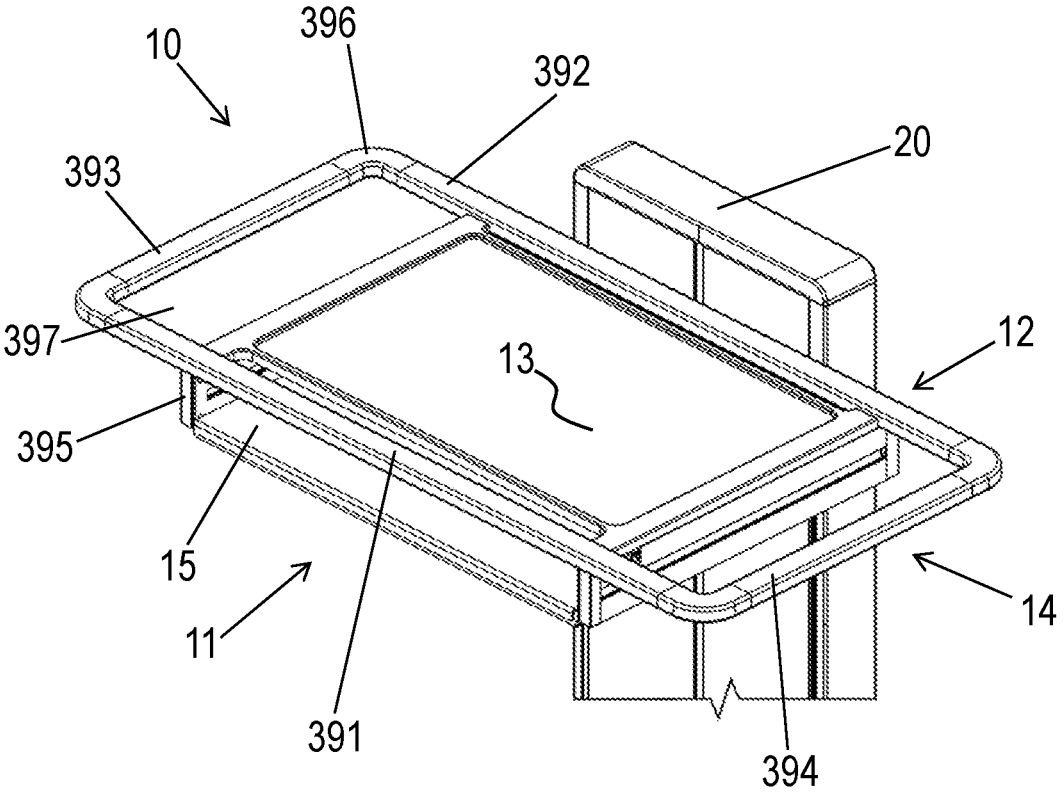
FIG. 32 is an upper perspective view of the head unit assembly of FIG. 1.
Figure 33:
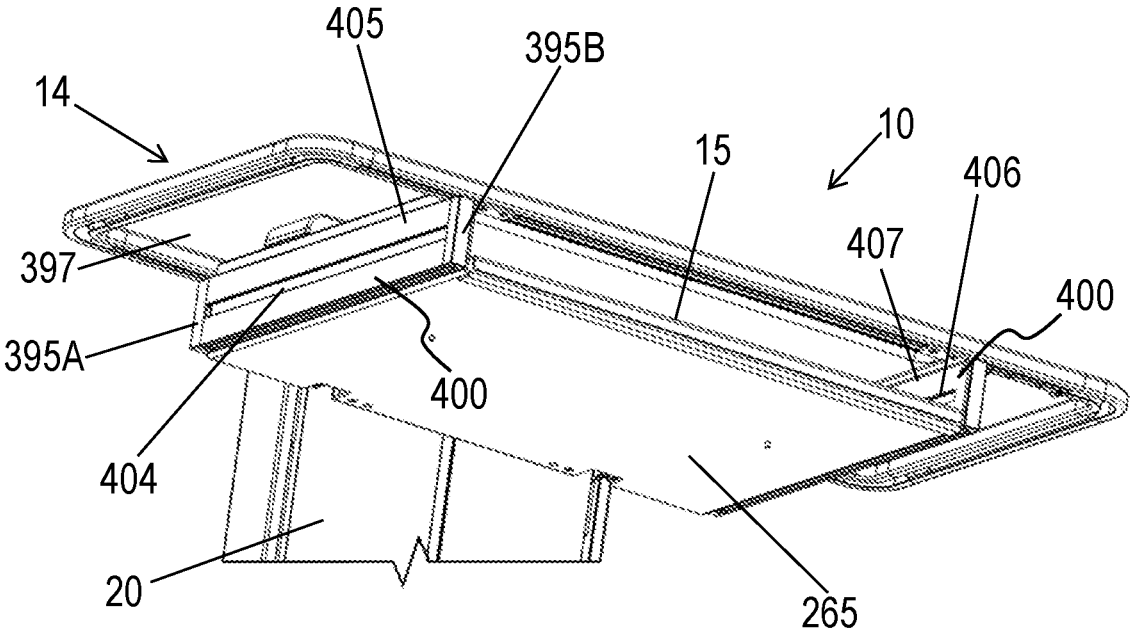
FIG. 33 is a lower perspective view of the head unit assembly of FIG. 1.

FIGS. 32-33 are an upper and a lower perspective views of the head unit assembly 10 of FIG. 1. The head unit assembly 10 can include a handle 14 coupled to a head unit chassis 265. The handle 14 can be used for dual purposes; (1) as a handle for transferring the workstation (e.g., the workstation 100 of FIG. 1) form a first place to a second place within a facility, and (2) as a bumper for protecting the workstation 100 against impact while transferring it through the facility (e.g., passing through doorways, or the like). The handle 14 can be made of known impact resistant, durable, soft engineering materials including, but not limited to, extruded aluminum, die cast aluminum, molded plastic, ABS, or the like.

In some example configurations, the handle 14 can have a first handle member 391 and a second handle member 392. The first handle member 391 can be located proximate to the front end 11 of the head unit assembly 10, and the second handle member 392 can be located proximate to the rear end 12 of the head unit assembly 10. The first handle member 391 and the second handle member 392 can be coupled to the head unit chassis 265 using one or more connectors 395 (for example, one or more connectors 395 can be located in each corner of the head unit chassis 265). The one or more connectors 395 can be coupled to the head unit chassis 265 and coupled to the first handle member 391 and the second handle member 392 to securely connect the handle 14 to the head unit chassis 265.

The handle 14 can further include a third handle member 393 and a fourth handle member 394. The third handle member 393 and the fourth handle member 394 can extend in a transverse direction to the first handle member 391 and the second handle member 392. The third handle member 393 can be located on one side of the head unit assembly 10 and the fourth handle member 394 can be located on the other side of the head unit assembly 10. A corner member 396 can be coupled to each end of the third handle member 393 and the fourth handle member 394. The corner members 396 can be used to couple the third handle member 393 and the fourth handle member 394 to the first handle member 391 and the second handle member 392 as illustrated in FIG. 32.

In some example configurations, the first handle member 391 and the second handle member 392 can be made longer than a width of the head unit chassis 265 to create a space 397 for attaching accessories to the sides of the head unit chassis 265 as illustrated in FIGS. 1-2. In other example configurations, the length of the first handle member 391 and the second handle member 392 can be close to a width of the head unit chassis 265 to reduce the overall footprint of the workstation (e.g., the workstation 100 of FIG. 1). In yet another example configuration, the first handle member 391 and the second handle member 392 can be made in adjustable lengths (e.g., a telescoping tubular structure, or the like). The user of the workstation 100 can adjust the lengths of the first handle member 391 and the second handle member 392 to create the space 397 for attaching various accessories to the head unit chassis 265.

The head unit assembly 10 can include one or more T-slot brackets 400. The one or more T-slot brackets 400 can be coupled to the one or both sides of the head unit chassis 265. The one or more T-slot brackets 400 can have an elongated structure extending between a first connector 395A and a second connector 395B. The one or more T-slot brackets 400 can have a first T-slot 404 formed on an outside surface 405 of the one or more T-slot brackets 400. The first T-slot 404 can extend at least a portion of a length of the one or more T-slot brackets 400 between the first connector 395A and the second connector 395B. The first T-slot 404 can be used to couple one or more accessories 18 to the head unit assembly 10 on the side of the worksurface 13 (e.g., outside the head unit chassis 265). In some configurations, a second T-slot 406 can be formed on an inner surface 407 of the one or more T-slot brackets 400. The second T-slot 406 can be used to couple accessories to the head unit assembly 10 under the worksurface 13 (e.g., inside the head unit chassis 265).

FIG. 34 is a rear perspective view of a workstation 140 according to an example configuration of the current disclosure. One or more accessories 24 (e.g., a shelf 24A, a drawer 24B, or the like) can be coupled to the support column 20 through the front T-slot 27 or the rear T-slot 28 located on the front face 25 and the rear face 26 of the support column 20, respectively. One or more T-slot inserts (not shown) can be inserted into one or both of the front T-slot 27 and the rear T-slot 28. One or more mechanical fasteners (not shown) can be used to couple the one or more T-slot inserts to the front T-slot 27 and the rear T-slot 28. The one or more T-slot inserts can engage with the one or more accessories (e.g., a shelf 24A, a drawer 24B, or the like) to securely attach them to the support column 20.

Figure 35:
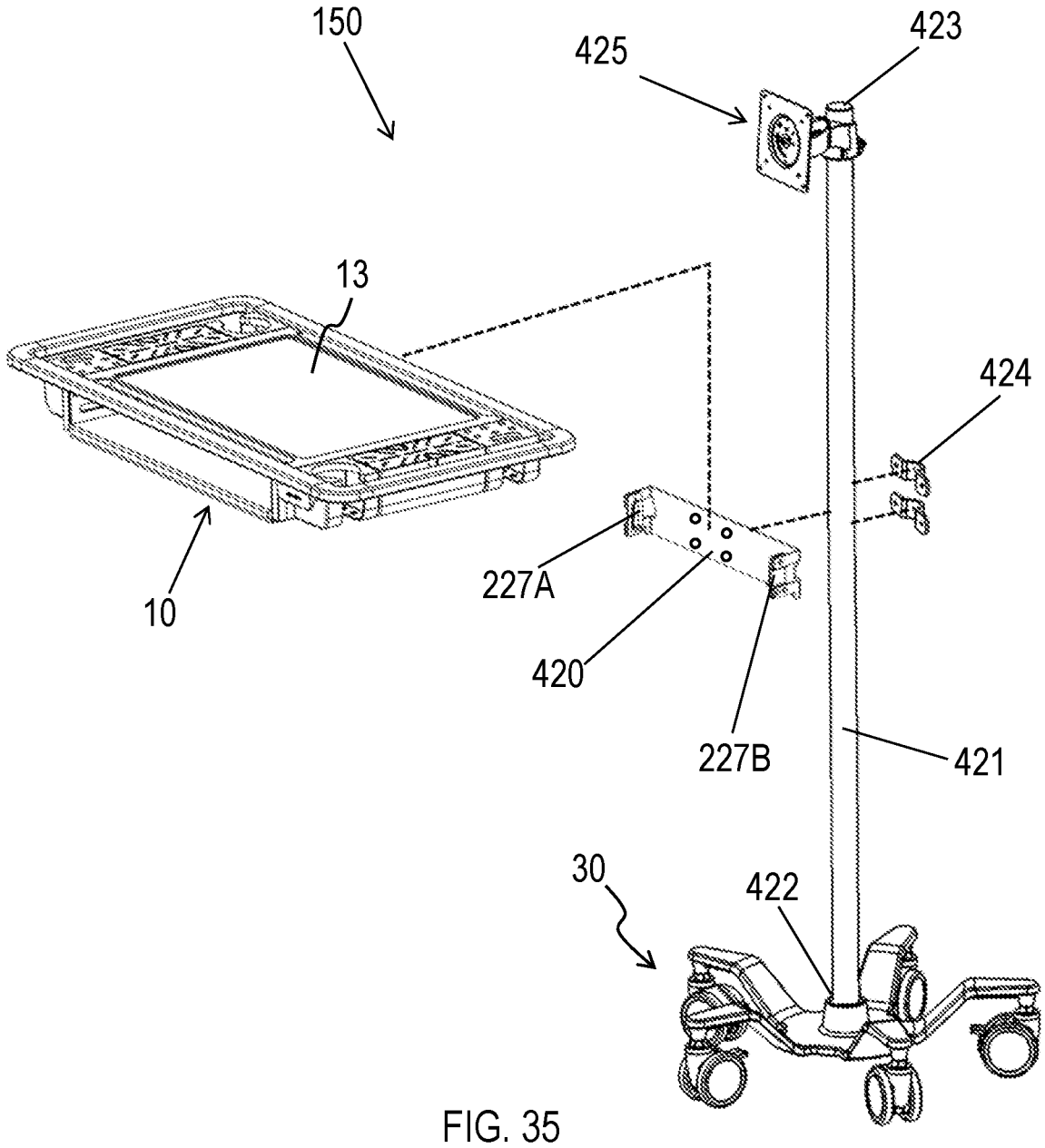
FIG. 35 is an exploded view of another workstation according to an example configuration of the current disclosure.

FIG. 35 is an exploded view of yet another workstation 150 according to an example configuration of the current disclosure. The workstation 150 can include a mounting bracket 420. The mounting bracket 420 can be similar to the movable bracket 220 of FIG. 13 (e.g., the mounting bracket 420 can have a first arm 221 and a second arm 222, or the like). The mounting bracket 420 can be adapted to be coupled to a structure (e.g., a pole 421).

The pole 421 can be an elongated member having a lower end 422 and an upper end 423. The pole 421 can be coupled to a wheeled base 30 at the lower end 422. The mounting bracket 420 can be coupled to the pole 421 using one or more braces 424 proximately in the middle of the pole 421. A tilt assembly 425 can be directly coupled to the pole 421 proximate the upper end 423 of the pole 421. The tilt assembly 425 can hold a display above the worksurface 13 of the head unit assembly 10.

A first coupler 227A and a second coupler 227B can be coupled to the mounting bracket 420. A head unit assembly (e.g., the head unit assembly 10 of FIG. 16) can be coupled to the mounting bracket 420 (e.g., the first receiver 250A can engage with the first coupler 227A and the second receiver 250B can engage with the second coupler 227B as explained in relation to FIGS. 12-20).

Figure 36:
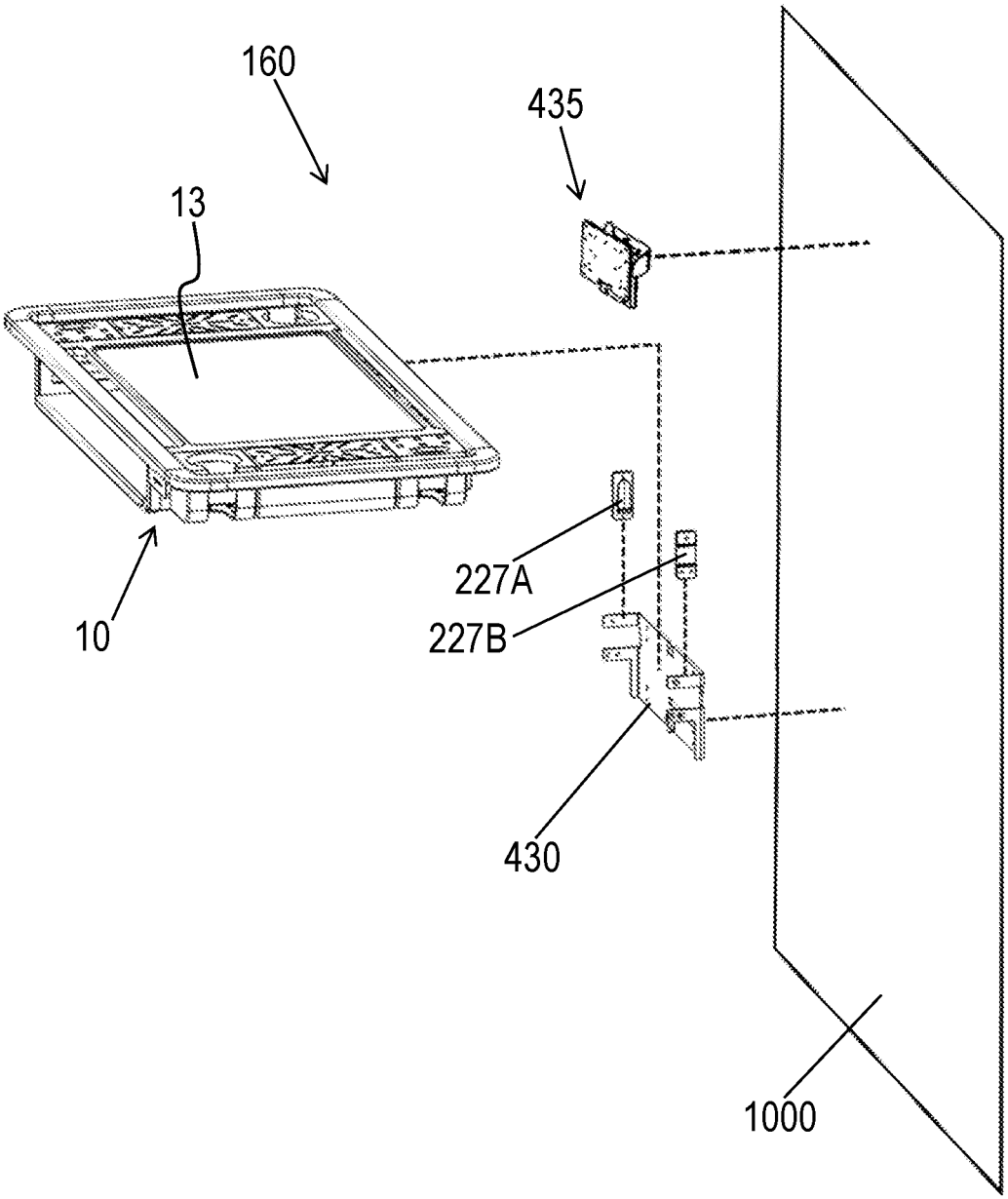
FIG. 36 is an exploded view of yet another workstation according to an example configuration of the current disclosure.

FIG. 36 is an exploded view of yet another workstation 160 according to an example configuration of the current disclosure. The workstation 160 can include a mounting bracket 430. The mounting bracket 430 can be similar to the movable bracket 220 of FIG. 13 (e.g., the mounting bracket 430 can have a first arm 221 and a second arm 222, or the like). The mounting bracket 430 can be adapted to be coupled to a structure (e.g., a wall 1000).

In an example configuration, one or more wall anchors (not shown) can be coupled to the mounting bracket 430 and coupled to the wall 1000 to securely attach the mounting bracket 430 to the wall 1000. A first coupler 227A and a second coupler 227B can be coupled to the mounting bracket 430. A head unit assembly (e.g., the head unit assembly 10 of FIG. 16 can be coupled to the mounting bracket 430 (e.g., the first receiver 250A can engage with the first coupler 227A and the second receiver 250B can engage with the second coupler 227B as explained in relation to FIGS. 12-20). One or more tilt assemblies 435 can be directly coupled to the wall 1000 above the head unit assembly 10. The one or more tilt assemblies 435 can position one or more displays over the worksurface 13 of the head unit assembly 10.

Going back to FIG. 29, in some example configurations, the workstation (e.g., the workstation 10 of FIG. 1) can include one or more sensors (e.g., a weight sensor 115, a lift force sensor 116, or the like). The workstation 10 can further include a lock mechanism 117 (e.g., a brake, lock, latch, or the like). The weight sensor 115 can be coupled between the head unit assembly 10 and the movable bracket 220. The weight sensor 115 can be configured to detect a combined weight of the head unit assembly 10 and all the components (e.g., one or more displays, one or more accessories, or the like) coupled to the head unit assembly 10. The combined weight of the head unit assembly 10 and all the components coupled to it can apply to the movable bracket 220 in a downwards direction 118.

The lift force sensor 116 can be coupled between the lift mechanism 372 and the movable bracket 220. The lift force sensor 116 can detect a magnitude of a lift force generated by the lift mechanism 372. The lift force can apply to the movable bracket 220 in an upwards direction 119. The lift force can counterbalance at least a portion of the combined weight of the head unit assembly 10 and all the components coupled to it. It is desirable that the difference between the combined weight and the lift force can be less than a threshold. In an example, the lift force sensor can be similar to (and can incorporate components of) the lift force sensor described in U.S. patent application Ser. No. 17/292,927 entitled "SYSTEM AND METHOD FOR LIFT FORCE ESTIMATION," filed on May 11, 2021, which is hereby incorporated by reference herein in its entirety.

The lock mechanism 117 can be coupled between the support column 20 and the head unit assembly 10. The lock mechanism 117 can be coupled to a lock release lever 17 shown in FIG. 1. The lock mechanism 117 can have a locked configuration and an unlocked configuration. In the locked configuration, the lock mechanism 117 can immobilize the head unit assembly 10 relative to the support column 20. In the unlocked configuration, the lock mechanism 117 can release the head unit assembly such that the head unit assembly 10 can move relative to the support column 20 to adjust a height of the head unit assembly 10. The lock mechanism 117 can be biased in the locked configuration. The user of the workstation (e.g., the workstation 10 of FIG. 1) can manipulate (e.g., pull, rotate, lift, push, or the like) the lock release lever 17 to selectively put the lock mechanism in to unlocked configuration to adjust the height of the head unit assembly 10 (e.g., from a sitting height to a standing height) when desired. In an example, the lock mechanism can be similar to (and can incorporate components of) the lock mechanism described in commonly assigned U.S. Pat. No. 11,071,377 to Lindblad et al., entitled "HEIGHT ADJUSTABLE PLATFORMS AND ASSOCIATED MECHANISMS", which is hereby incorporated by reference herein in its entirety.

In some example configurations, the workstation 10 can further include a controller 111. The controller 111 can be included inside the head unit assembly 10 as illustrated in FIG. 2. The weight sensor 115 and the lift force sensor 116 can be electronically coupled to the controller 111. The weight sensor 115 can provide a weight sensor output, and the lift force sensor 116 can provide a lift force sensor output. The controller 111 can receive the weight sensor output and lift force sensor output and issues a control signal based on a preprogrammed logic.

In some example configurations, if the weight sensor output and the lift force sensor output received by the controller 111 indicate that the difference between the combined weight (including the weight of the head unit assembly 10 and all the components coupled to the head unit assembly 10) and the lift force generated by the lift mechanism 372 exceeds a threshold (e.g., the difference is larger than the maximum allowable difference), the controller 111 can issue a control signal to deactivate the lock release lever 17 so that the user of the workstation 10 cannot put the lock mechanism 117 in the unlocked configuration.

Figure 37:
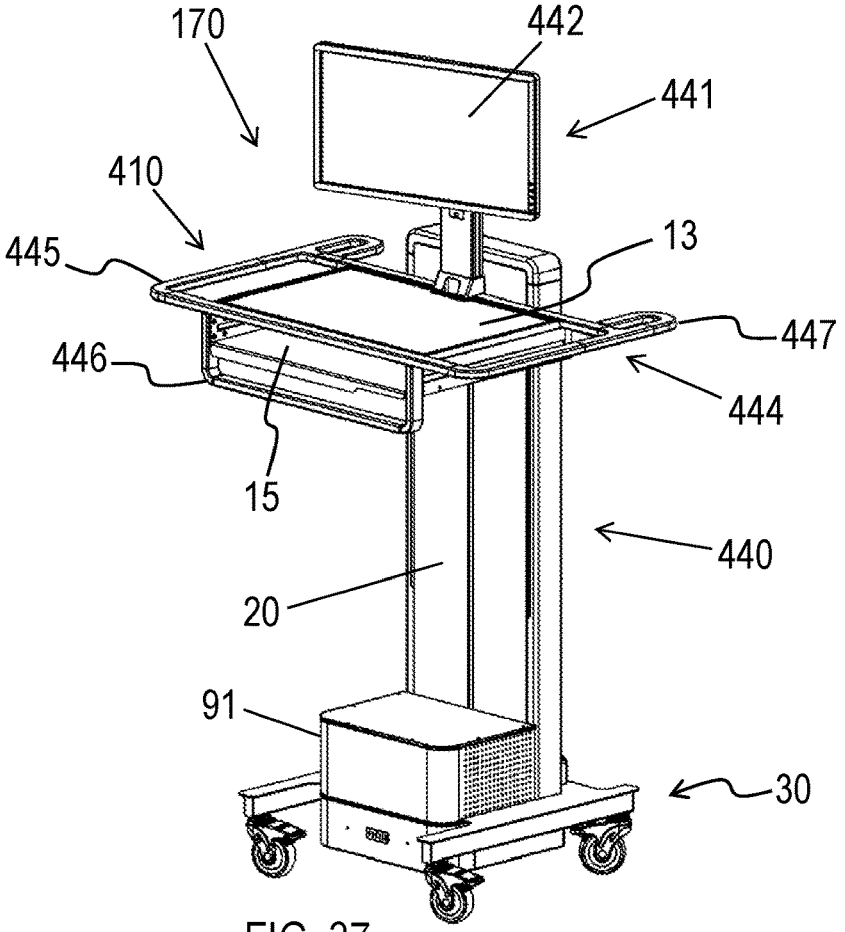
FIG. 37 is a front perspective view of a workstation according to an example configuration of the current disclosure.

FIG. 37 is a perspective view of yet another workstation 170 according to an example configuration of the current disclosure. The workstation 170 can include a wheeled base 30 and a support column 20 coupled to the wheeled base 30. The wheeled base 30 can be adapted to move the workstation 170 from a first place to a second place within a facility. The wheeled base 30 can project from the support column 20 in at least forward direction. A power system housing 91 can be coupled to the wheeled base 30 in the section of the wheeled base 30 projecting from the support column 20 in forward direction.

The support column 20 can be coupled to the wheeled base 30 at a first end and a head unit assembly 410 can be coupled to the support column 20 proximate a second end. The head unit assembly 410 can project from the support column 20 in forward direction. In some example configurations, the head unit assembly 410 can be slidingly engaged with the support column 20.

In some example configurations, a first height adjustment mechanism 440 (e.g., similar to the lift mechanism of FIG. 29, or the linear actuator 380 of FIG. 30) can be contained in the support column 20. The first height adjustment mechanism 440 can be coupled between the support column 20 and the head unit assembly 410. The first height adjustment mechanism 440 can be configured to adjust a distance between the wheeled base 30 and the head unit assembly 410. In some example configurations, the first height adjustment mechanism 440 can include a lock mechanism (e.g., similar to the lock mechanism 117 of FIG. 29) and a weight counterbalance mechanism (e.g., similar to the weight counterbalance mechanism 373 of FIG. 29). The lock mechanism is configured to immobilize the first height adjustment mechanism 440 to maintain the head unit assembly 410 at a desired position. The weight counterbalance mechanism is configured to lift at least a portion of the weight of the head unit assembly 410 to reduce the force exerted by the user of the workstation 170 to change a position of the head unit assembly 410.

The head unit assembly 410 can include a worksurface 13 and a keyboard tray 15. The worksurface 13 can be an unencumbered surface. It can be used as the primary worksurface by the user of the workstation 170 (e.g., placing work related items and papers, using it as a writing surface, or the like). A display mounting assembly 441 can be coupled to the head unit assembly 410. The display mounting assembly 441 can be configured to hold a display 442 above the worksurface 13. In some example configurations, the display mounting assembly 441 can include a second height adjustment mechanism 499 (shown in FIG. 41). The second height adjustment mechanism 499 can adjust a distance between the display 442 and the worksurface 13.

The keyboard tray 15 can be located below the worksurface 13 and it can be slidingly engaged with the head unit assembly 410. The keyboard tray 15 can move at least in forward and backward direction relative to the head unit assembly 410. An input device (e.g., a keyboard, not shown) can be located over the key board tray 15. The input device can be coupled to a workstation computer (not shown) located on the workstation 170. In some example configurations, the computer can be located inside the housing of the display 442 (e.g., all-in-one displays). The input device can be useful to provide interaction between the user of the workstation 170 and the workstation computer as required by the workstation tasks (e.g., data entry, user authentication, messaging, performing calculations, or the like).

In some example configurations, a handle 444 can be coupled to the head unit assembly 410. The handle 444 can include a primary handle 445 and a drop-down handle 446. The primary handle 445 can wrap around at least a portion of the head unit assembly 410 (for example, proximate to the worksurface 13). The user of the workstation 170 can interact with the primary handle 445 to move the workstation 170 from a first place to a second place within a facility. The primary handle 445 can include one or more rear extensions 447 on one or both sides of the head unit assembly 410. The one or more rear extensions 447 can provide easy access to the handle 444 for a user positioned on the rear of the workstation 170.

The drop-down handle 446 can be coupled to the primary handle 445 and it can project from the primary handle 445 in a downward direction. The drop-down handle 446 can be proximate to the front end 11 of the head unit assembly 410. A lock release lever 19 (shown in FIG. 38) can be coupled to the drop-down handle 446. The lock release lever 19 can be operationally coupled to the lock mechanism (e.g., the lock mechanism 117 of FIG. 29). The user of the workstation 170 can manipulate the lock release lever 19 (e.g., push, pull, rotate, or the like) to unlock the lock mechanism 117 such that a height of the head unit assembly 410 can be adjusted.

Figure 38:
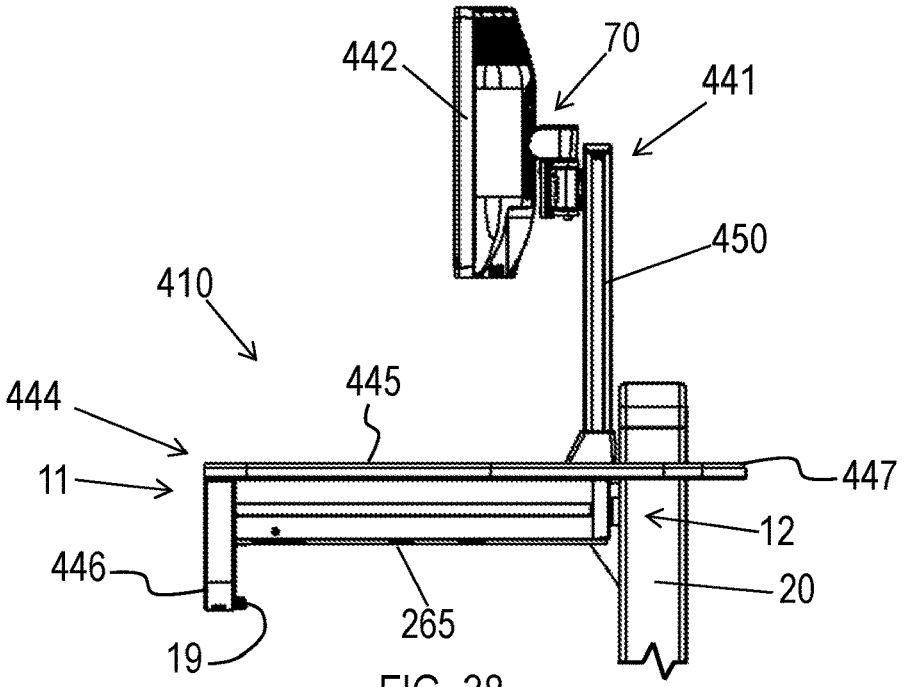
FIG. 38 is a side view of the head unit assembly of FIG. 37.
Figure 39:
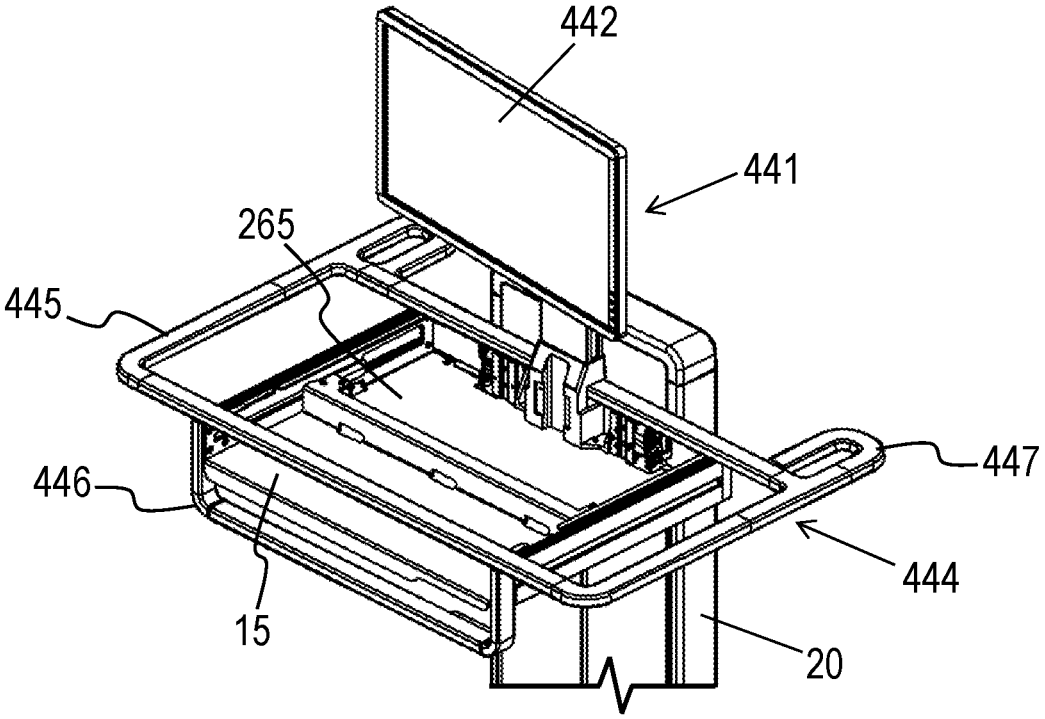
FIG. 39 is a perspective view of the head unit assembly of FIG. 37.

FIGS. 38-39 are a side and a perspective views of the head unit assembly 410 of FIG. 37, respectively. The worksurface 13 is removed in FIG. 39 to show the components normally hidden under the worksurface 13. A head unit chassis 265 can be coupled to the support column 20. The handle 444, the worksurface 13, the key board tray 15, and the display mounting assembly 441 can be coupled to the head unit chassis 265. In some example configurations, the workstation 170 of FIG. 37 can further include a tilt assembly (e.g., similar to the tilt assembly 70 of FIG. 4). The tilt assembly 70 can be coupled to the display 442 and removably coupled to the display mounting assembly 441.

Figure 40:
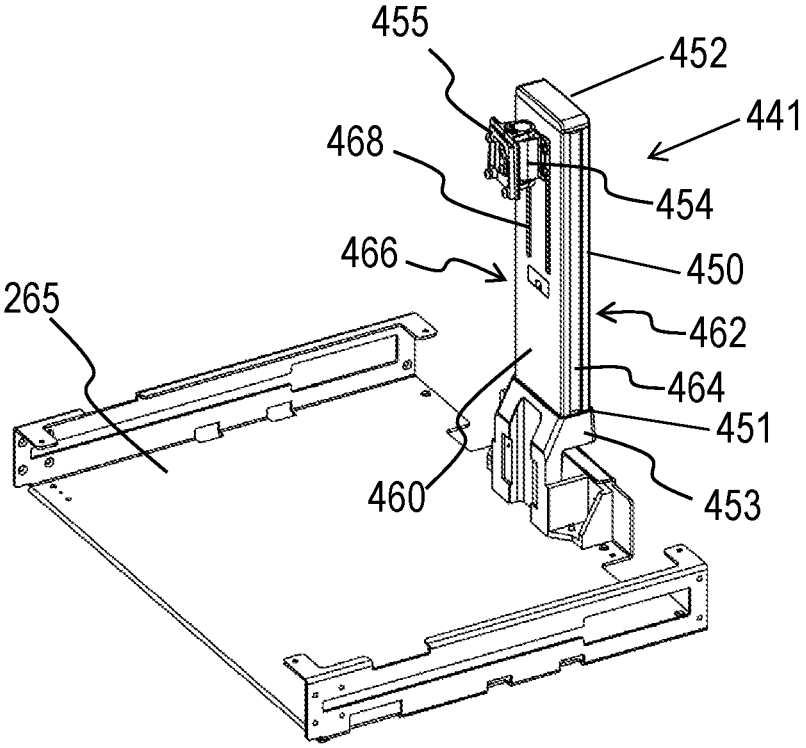
FIG. 40 is a perspective view of the sub-assembly between the head unit chassis and the display mounting assembly of FIG. 39.

FIG. 40 is a perspective view of the sub-assembly between the head unit chassis 265 and the display mounting assembly 441. The display mounting assembly 441 can include a display mounting riser 450. The display mounting riser 450 can be an elongated member between a first end 451 and a second end 452. In some example configurations, a block 453 can be coupled to the head unit chassis 265. The display mounting riser 450 can be coupled to the block 453 at the first end 451 and a link bracket 454 can be coupled to the display mounting riser 450 proximate to the second end 452. The link bracket 454 can be configured to translate through at least a portion of the display mounting riser 450 between the first end 451 and the second end 452.

In some example configurations, a pan bracket 455 can be rotatingly coupled to the link bracket 454. The pan bracket 455 is configured to rotate relative to the link bracket 454 around a first axis 456 (shown in FIG. 41). The first axis 456 can be in a vertical direction. In some example configurations, the tilt assembly 70 can be removably coupled to the pan bracket 455.

The display mounting assembly 441 can have a front wall 460 and a rear wall 462 opposite the front wall 460. The front wall 460 can be coupled to the rear wall 462 via a right-side wall 464 and the left-side wall 466. In some example configurations, one or more elongated slots 468 can be formed on the front wall 460 of the display mounting riser 450.

Figure 41:
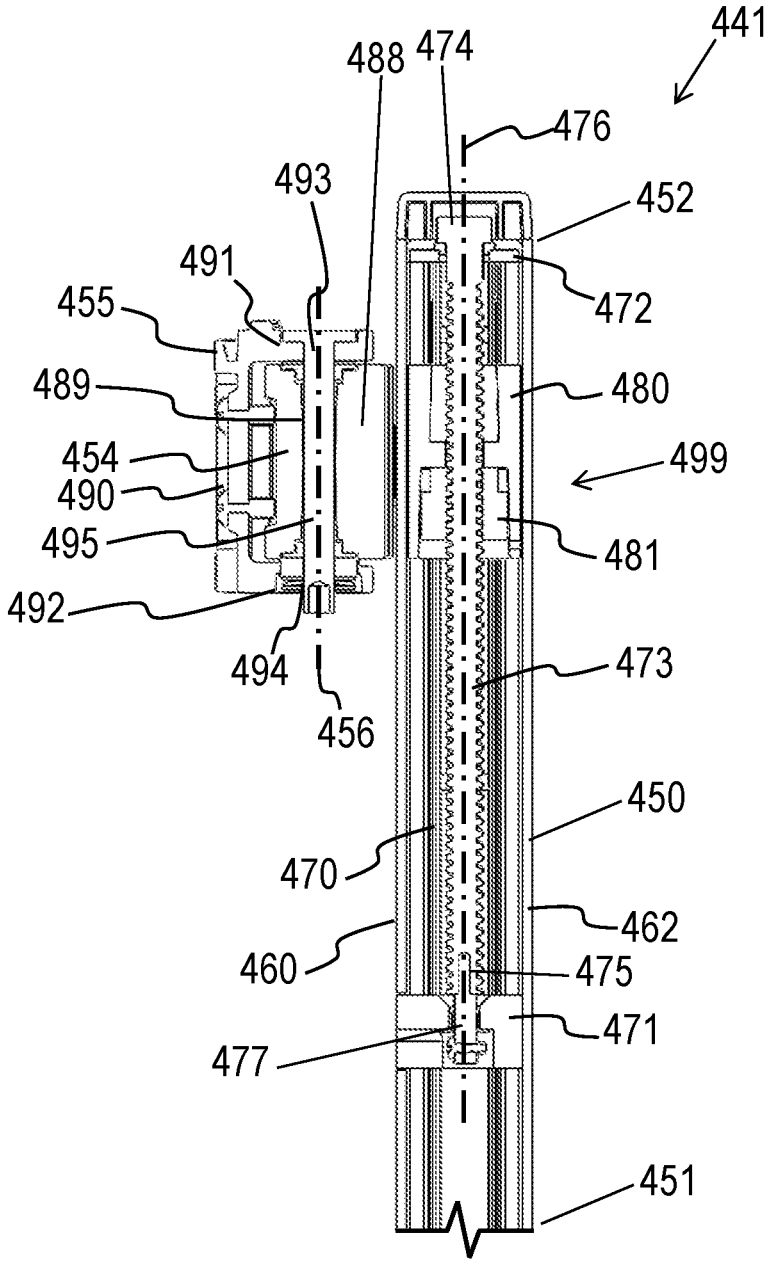
FIG. 41 is a cross-sectional view of the display mounting assembly of FIG. 38.

FIG. 41 is a cross-sectional view of the display mounting assembly 441 of FIG. 40 according to an example configuration of the current disclosure. An elongated cavity 470 can be formed inside the display mounting riser 450 between the front wall 460, the rear wall 462, the right-side wall 464, and the left-side wall 466. The elongated cavity 470 can extend between the first end 451 and the second end 452. The display mounting riser 450 can have a known cross-section (e.g., rectangular, square, round, elliptical or the like). The cross-section of the display mounting riser 450 can be constant at least a portion of the display mounting riser 450. The display mounting riser 450 can be made of one or more of known engineering materials including, but not limited to, extruded aluminum, die cast aluminum, molded plastic, or the like. In some configurations, the display mounting riser 450 can be made of multiple components and coupled together during the assembly operation.

A bottom bracket 471 can be fixedly attached to the display mounting riser 450 proximate the first end 451, and a top bracket 472 can be fixedly attached to the display mounting riser 450 proximate to the second end 452. A lead screw 473 can be located in the elongated cavity 470. The lead screw 473 can extend from the top bracket 472 to the bottom bracket 471. The lead screw 473 can be rotatingly coupled with the top bracket 472 and the bottom bracket 471. The lead screw 473 can rotate around a second axis 476 relative the display mounting riser 450. The second axis 476 can be formed by the center line of the lead screw 473, and it can be parallel to the longitudinal direction of the display mounting riser 450.

The lead screw 473 can have a screw head 474 on one end, and a threaded hole 475 can be formed on the other end. The screw head 474 can engage with the top bracket 472. A mechanical fastener 477 (e.g., a screw) can engage with the threaded hole 475 and the bottom bracket 471 to couple the lead screw 473 to the bottom bracket 471. A displacement of the lead screw 473 in the direction of the second axis 476 can be prevented by the top bracket 472 and the bottom bracket 471.

In some example configurations, a carriage 480 can be located inside the elongated cavity 470. The carriage 480 can be slidingly engaged with the display mounting riser 450. The carriage 480 can be guided by one or more of the front wall 460, the rear wall 462, the right-side wall 464, and the left-side wall 466. A nut 481 can be fixedly attached to the carriage 480. In some example configurations, the nut 481 can be formed as an integral part of the carriage 480. The lead screw 473 can be at least partially located inside the nut 481. The lead screw 473 can be threadingly engaged with the nut 481. The carriage 480 and the nut 481 can be configured to translate along a portion of the lead screw 473 in parallel to the second axis 476 as the lead screw 473 is rotated.

A link bracket 454 can be coupled to the carriage 480. The link bracket 454 can be at least partially located outside the display mounting riser 450 proximate to the front wall 460. The link bracket 454 can have a link bracket body 488. A through hole 489 can be formed on the link bracket body 488. One or more protrusions (not shown) can be formed on the link bracket body 488 facing the display mounting riser 450. The one or more protrusions can penetrate through the one or more elongated slots 468 (shown in FIG. 40) and engage with the carriage 480. One or more mechanical fasteners (not shown) can be used to securely attach the link bracket 454 to the carriage 480.

In some example configurations, a pan bracket 455 can be rotatingly coupled to the link bracket 454. The pan bracket 455 can be formed in a U-shaped construction as illustrated in FIG. 41. The pan bracket 455 can have a base 490. A first arm 491 and a second arm 492 can extend from the base 490 in transverse direction. The second arm 492 can be spaced apart from the first arm 491. A first aperture 493 and a second aperture 494 can be formed on the first arm 491 and the second arm 492, respectively.

The pan bracket 455 can be configured to receive the link bracket 454 between the first arm 491 and the second arm 492 such that the first aperture 493, the through hole 489 and the second aperture 494 can be concentric. A mechanical fastener 495 (e.g., a screw, a rivet, or the like) can be inserted through the first aperture 493, the through hole 489 and the second aperture 494 to rotatingly couple the pan bracket 455 with the link bracket 454. The mechanical fastener 495 can form the rotation axis (e.g., the first axis 456) between the pan bracket 455 and the link bracket 454.

In some example configurations, a display (e.g., the display 442 of FIG. 38) can be coupled to a tilt assembly 70. The tilt assembly 70 can be removably coupled to the pan bracket 455 to couple the display 442 to the display mounting assembly 441. The display 442 can be rotatingly coupled to the display mounting riser 450 around the first axis 456.

The carriage 480, the nut 481, and the lead screw 473 together can form the second height adjustment mechanism 499. The second height adjustment mechanism 499 can be configured to adjust a height of the display 442 relative to the display mounting riser 450.

FIGS. 42A-42B are perspective views of a power system housing 500. The power system housing can be similar to the power system 91 of FIG. 28. A power system 90 including a power module 369 and one or more batteries 368 can be located inside the power system housing 500. The power system housing 500 can include one or more limbs 502. The one or more limbs 502 can interact with one or more seats coupled to the wheeled base (e.g., the first seat 361 and the second seat 362 coupled to the wheeled base 30 of FIG. 28) to mount the power system housing 500 to the wheeled base 30 as discussed in previous sections in relation to FIG. 28. In some example configurations, the one or more limbs 502 can include a first aperture 503, and the one or more seats can include a second aperture (not shown).

In some example configurations, one or more lock levers 504 can be coupled to the power system housing 500 proximate to the one or more limbs 502. In some example configurations, the one or more lock levers 504 can be rotatingly coupled to the power system housing 500. In other example configurations, the one or more lock levers 504 can be slidingly engaged with the power system housing 500. The one or more lock levers 504 can include a hook 506.

The one or more lock levers 504 can have an unlocked configuration as illustrated in FIG. 42A and a locked configuration as illustrated in FIG. 42B. In the unlocked configuration, the hook 506 can be away from the one or more limbs 502, and in the locked configuration, the hook 506 can be positioned proximate to the one or more limbs 502. After the power system housing 500 located on the wheeled base 30 (e.g., the one or more limbs 502 can be placed over the first seat 361 and the second seat 362), the one or more lock levers 504 can be put into the locked configuration. In the locked configuration, the hook 506 can engage with the first aperture 503 located on the one or more limbs 502 and the second aperture (not shown) located on the on the one or more seats (e.g., located on the first seat 361 and the second seat 362) to immobilize the power system housing 500 relative to the wheeled base 30. In some example configurations, the one or more lock levers 504 can be biased towards the locked configuration to prevent accidental unlocking and removal of the power system housing 500 from the wheeled base 30. The user of the workstation can intentionally put the one or more lock levers 504 in the unlocked configuration to be able to remove the power system housing 500 from the wheeled base 30 when needed.

In other example configurations, the one or more lock levers 504 can be coupled to the wheeled base 30. After the power system housing 500 is placed over the wheeled base 30, the one or more lock levers 504 can engage with the power system housing 500 to securely attach the power system housing 500 to the wheeled base 30.

Additional Notes and Aspects

Aspect 1 may include or use subject matter (such as an apparatus, a system, a device, a method, a means for performing acts, or a device readable medium including instructions that, when performed by the device, may cause the device to perform acts), such as may include or use a workstation comprising: a head unit assembly having a front end and a rear end, the head unit assembly including: a head unit chassis; a worksurface coupled to the head unit chassis; a handle located proximate the worksurface, wherein the handle is coupled to the head unit chassis; and one or more receivers located proximate the rear end, wherein the one or more receivers are coupled to the head unit chassis; a bracket including: a base; and one or more arms; wherein the one or more arms are coupled to the base, and wherein the one or more arms extend from the base in a transverse direction; and one or more couplers, wherein the one or more couplers are coupled to the one or more arms; wherein the base is adapted to couple to a structure; and wherein the one or more receivers are configured to receive the one or more couplers to removably couple the head unit assembly to the structure.

Aspect 2 may include or use, or may optionally be combined with the subject matter of Aspect 1, to optionally include or use wherein the structure is selected from a group consisting of a support column, a wheeled base, a cabinet, a rack, a pole, and a wall.

Aspect 3 may include or use, or may optionally be combined with the subject matter of Aspect 1, to optionally include or use wherein the head unit assembly further includes a keyboard tray, wherein the keyboard tray is located below the worksurface, and wherein the keyboard tray is slidably engaged with the head unit chassis.

Aspect 4 may include or use, or may optionally be combined with the subject matter of Aspect 1, to optionally include or use wherein the head unit assembly further includes: a shelf assembly, wherein the shelf assembly is coupled to the head unit chassis over the worksurface; and one or more risers coupled to the shelf assembly; wherein the one or more risers are configured to hold one or more flat panel displays over the worksurface.

Aspect 5 may include or use subject matter (such as an apparatus, a system, a device, a method, a means for performing acts, or a device readable medium including instructions that, when performed by the device, may cause the device to perform acts), such as may include or use a workstation comprising: a head unit assembly; a support column having a lower end and an upper end, wherein the support column is elongated between the lower end and the upper end in vertical direction, the support column includes: a block coupled to the lower end, wherein the block includes one or more channels; and a movable bracket movably coupled to the support column proximate the second end; and a housing member adapted to couple to a structure, wherein the housing member includes a hollow section having one or more guides; wherein the one or more channels are configured to coincide with the one or more guides; wherein the housing member is configured receive the block into the hollow section guided by the one or more guides and one or more channels; wherein the head unit assembly removably coupled to the movable bracket; and wherein the support column and the housing member cooperate to removably couple the head unit assembly to the structure.

Aspect 6 may include or use, or may optionally be combined with the subject matter of Aspect 5, to optionally include or use wherein the structure is a wheeled base, and wherein the wheeled base is adapted to transfer the workstation within a facility.

Aspect 7 may include or use, or may optionally be combined with the subject matter of Aspect 5, to optionally include or use wherein the movable bracket includes: a base; and one or more arms; wherein the base is contained inside the support column and the one or more arms extend out of the support column in a transverse direction; and wherein the head unit assembly is removably coupled to the one or more arms.

Aspect 8 may include or use, or may optionally be combined with the subject matter of Aspect 5, to optionally include or use wherein the workstation further includes: a power system housing having a first side and a second side opposite the first side, wherein a first limb is coupled to the first side and a second limb is coupled to the second side; a first seat; and a second seat; wherein the first seat and the second seat are coupled to the wheeled base; wherein the first seat and the second seat coincide with the first limb and the second limb, respectively; and wherein the first seat and the second seat are adapted to be coupled with the first limb and the second limb, respectively, to couple the power system housing with the wheeled base.

Aspect 9 may include or use, or may optionally be combined with the subject matter of Aspect 8, to optionally include or use wherein the power system housing includes: a power module having an AC/DC power supply, an inverter, a control logic circuit, and a battery charging circuit; and one or more batteries; wherein the power module is configured to provide power to one or more electrical components coupled to the workstation.

Aspect 10 may include or use subject matter (such as an apparatus, a system, a device, a method, a means for performing acts, or a device readable medium including instructions that, when performed by the device, may cause the device to perform acts), such as may include or use a workstation comprising: a wheeled base adapted to transfer the workstation within a facility; a support column coupled to the wheeled base; wherein the support column includes: a movable bracket; and a height adjustment mechanism contained inside the support column; a head unit assembly coupled to the support column; the head unit assembly includes: a head unit chassis; a worksurface coupled to the head unit chassis; and a keyboard; wherein the head unit assembly is configured to house a computer; and wherein the height adjustment mechanism is coupled between the support column and the head unit chassis; one or more risers coupled to the head unit assembly, wherein the one or more risers are configured to hold one or more flat panel displays over the worksurface; and a power system housing coupled to the wheeled base, the power system housing includes: a power module; and a battery, wherein the power module is electrically coupled to the battery, the computer, and the one or more flat panel displays, and wherein the power module is configured to provide electrical power to the computer and the flat panel display; wherein the head unit assembly is slidingly engaged with the support column; and wherein the height adjustment mechanism is configured to adjust a height of the head unit assembly relative to the wheeled base.

Aspect 11 may include or use, or may optionally be combined with the subject matter of Aspect 10, to optionally include or use wherein the support column further includes one or more couplers, wherein the one or more couples are coupled to the movable bracket.

Aspect 12 may include or use, or may optionally be combined with the subject matter of Aspect 11, to optionally include or use wherein the head unit further includes one or more receivers; wherein the one or more receivers are coupled to the head unit chassis; and wherein the one or more receivers are configured to receive the one or more couplers to removably couple the head unit assembly to the movable bracket.

Aspect 13 may include or use, or may optionally be combined with the subject matter of Aspect 10, to optionally include or use the workstation further comprising a handle having a primary handle and a secondary handle, wherein the primary handle is coupled to the head unit chassis and located proximate the worksurface; wherein the secondary handle is coupled to the primary handle; and wherein the secondary handle extends from the primary handle in downwards direction.

Aspect 14 may include or use, or may optionally be combined with the subject matter of Aspect 13, to optionally include or use wherein the head unit assembly further comprising an actuator, wherein the actuator is coupled to the secondary handle; wherein the actuator is coupled to the height adjustment mechanism; and wherein the actuator is configured to activate the height adjustment mechanism to move the head unit assembly relative to the support column.

Aspect 15 may include or use, or may optionally be combined with the subject matter of Aspect 10, to optionally include or use wherein the workstation further comprising one or more lock assemblies; wherein the one or more lock assemblies can be coupled to either one of the power system housing or the wheeled base; and wherein the one or more lock assemblies engage with the other one of the power system housing or the wheeled base to secure the power system housing on the wheeled base.

Each of these non-limiting examples can stand on its own or can be combined in any permutation or combination with any one or more of the other examples.

The above detailed description includes references to the accompanying drawings, which form a part of the detailed description. The drawings show, by way of illustration, specific embodiments in which the present subject matter can be practiced. These embodiments are also referred to herein as "examples." Such examples can include elements in addition to those shown or described. However, the present inventor also contemplates examples in which only those elements shown or described are provided. Moreover, the present inventor also contemplates examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72 (b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the present subject matter should be determined with reference to the appended claims, along with the full scope of equivalents to which such claims are entitled.

The invention claimed is:

1. A workstation comprising:

a head unit assembly including a work surface; and a support column extending between a first portion and a second portion, the head unit assembly configured to be removably coupled to the first portion, the second portion including:

an attachment block extending axially from the second portion of the support column away from the first portion of the support column; and a housing member including a hollow section configured to receive the attachment block at least partially therein to couple the support column to the housing member, the housing member couplable to a structure to couple the workstation to the structure;

wherein the housing member includes attachment guides extending into the hollow section, wherein the attachment block includes attachment channels formed in the attachment block and extending toward a center of the attachment block, and wherein the attachment guides and the attachment channels are complementary such as to locate the support column relative to the housing member; and wherein the support column comprises a front face configured to face the head unit assembly when the head unit assembly is attached to the support column, the front face including:

a first opening; and a second opening laterally spaced from the first opening, the first opening and the second opening extending through the front face and extending longitudinally along at least a portion of the support column.

2. The workstation of claim 1, wherein the housing member is selectively couplable to one of a mobile base, a wall, a cabinet, a rack, or a pole.

3. The workstation of claim 1, wherein the attachment block has a smaller axial cross-sectional area than an axial cross-sectional area of the support column.

4. The workstation of claim 1, the housing member comprising:

an auto-locking feature configured to secure the attachment block into the housing member as the attachment block is inserted into the housing member.

5. The workstation of claim 1, comprising:

a mobile base including a plurality of wheels, the housing member configured to couple to the mobile base opposite the plurality of wheels, the mobile base configured to facilitate rolling the workstation about a flooring surface.

6. The workstation of claim 5, wherein at least one wheel of the plurality of wheels comprises a lock to prevent movement of the mobile base around a facility when the lock is moved to a locked position.

7. The workstation of claim 5, further comprising:

a power system housing removably coupled to the mobile base and configured to house a power module and a battery, the power module and the battery configured to supply electrical power to electronic components of the workstation.

8. The workstation of claim 7, wherein the power system housing comprises:

a locking mechanism configured to secure the power module within the power system housing.

9. The workstation of claim 1, wherein the housing member is configured to attach to a wall of a facility to secure the workstation within the facility.

10. The workstation of claim 9, comprising:

a security bracket configured to be coupled to the wall, the security bracket configured to engage the first portion of the support column to limit motion of the workstation.

11. The workstation of claim 1, comprising:

a first arm configured to transversely extend through the first opening; and a second arm configured to transversely extend through the second opening;

wherein the first arm and the second arm are coupled to the head unit assembly; and wherein the first arm and the second arm are configured to slidingly couple the head unit assembly to the support column such that the head unit assembly can translate along at least a portion of the support column.

12. The workstation of claim 1, wherein the head unit assembly comprises:

a head unit chassis configured to couple the work surface to the head unit assembly; and a keyboard tray located below the work surface, the keyboard tray slidably engaged with the head unit chassis so that the keyboard tray is translatable toward and away from the support column.

13. A mobile workstation, comprising:

a mobile base including a plurality of wheels for enabling mobility of the mobile workstation;

a head unit assembly including a work surface; and a support column extending between a first portion and a second portion, the head unit assembly configured to be removably coupled to the first portion, the second portion including:

an attachment block extending axially from the second portion of the support column away from the first portion of the support column; and a housing member configured to be attached to the mobile base, the housing member including a hollow section configured to receive the attachment block to couple the support column to the mobile base;

wherein the support column includes:

a front face configured to face the head unit assembly when the head unit assembly is attached to the support column, the front face including:

a first opening; and a second opening, the first opening laterally spaced from the second opening, the first opening and the second opening extending through the front face and extending longitudinally along at least a portion of the support column;

a first arm configured to transversely extend through the first opening; and a second arm configured to transversely extend through the second opening;

wherein the first arm and the second arm are configured to slidingly couple the head unit assembly to the support column such that the head unit assembly can translate along at least a portion of the support column.

14. The mobile workstation of claim 13, wherein at least one wheel of the plurality of wheels comprises a lock to prevent movement of the mobile base.

15. The mobile workstation of claim 13, further comprising:

a power system housing removably coupled to the mobile base and configured to house a power module and a battery to supply electrical power to electronic components of the mobile workstation.

16. The mobile workstation of claim 15, wherein the power system housing comprises:

a locking mechanism configured to secure the power module within the power system housing.

17. A workstation comprising:

a head unit assembly including a work surface; and a support column extending between a first portion and a second portion, the head unit assembly configured to be removably coupled to the first portion, the second portion including:

an attachment block extending axially from the second portion of the support column away from the first portion of the support column; and a housing member including a hollow section configured to receive the attachment block at least partially therein to couple the support column to the housing member, the housing member couplable to a structure to couple the workstation to the structure;

wherein the attachment block and the second portion of the support column are formed of a single piece.

18. The workstation of claim 17, wherein the housing member is selectively couplable to one of a mobile base, a wall, a cabinet, a rack, or a pole.

19. The workstation of claim 17, wherein the attachment block has a smaller axial cross-sectional area than an axial cross-sectional area of the support column.

20. The workstation of claim 17, wherein the housing member includes an auto-locking feature configured to secure the attachment block into the housing member as the attachment block is inserted into the housing member.

* * * * *